US007913810B2

(12) United States Patent
Meneely et al.

(10) Patent No.: US 7,913,810 B2
(45) Date of Patent: Mar. 29, 2011

(54) HIGH-PERFORMANCE MUFFLER ASSEMBLY WITH MULTIPLE MODES OF OPERATION

(75) Inventors: Vincent A. Meneely, Langley (CA); Brad Sebring, Abbotsford (CA); Gabriel Gavril, Coquitlam (CA)

(73) Assignee: Pacbrake Company, Seattle, WA (US)

( * ) Notice: Subject to any disclaimer, the term of this patent is extended or adjusted under 35 U.S.C. 154(b) by 0 days.

(21) Appl. No.: 12/719,446

(22) Filed: Mar. 8, 2010

(65) Prior Publication Data

US 2010/0170743 A1 Jul. 8, 2010

(51) Int. Cl.
*F01N 1/02* (2006.01)
*F01N 1/08* (2006.01)
*F01N 1/00* (2006.01)

(52) U.S. Cl. ..... 181/254; 181/237; 60/324

(58) Field of Classification Search ..... 181/254, 181/253, 237, 251, 268, 275, 241, 271, 227, 181/228; 60/322, 324
See application file for complete search history.

(56) References Cited

U.S. PATENT DOCUMENTS

| | | | | | |
|---|---|---|---|---|---|
| 1,613,322 | A | * | 1/1927 | Goetz | 181/254 |
| 1,709,426 | A | * | 4/1929 | Beery | 181/254 |
| 1,781,001 | A | * | 11/1930 | Eisele | 181/254 |
| 1,840,082 | A | * | 1/1932 | Breer | 181/254 |
| 1,860,146 | A | * | 5/1932 | Gray | 181/254 |
| 2,072,372 | A | * | 3/1937 | Riethmiller | 181/264 |
| 2,157,030 | A | * | 5/1939 | Starkweather et al. | 181/254 |
| 2,404,589 | A | * | 7/1946 | Monaghan | 181/232 |
| 2,625,234 | A | * | 1/1953 | Fina | 181/239 |
| 3,154,174 | A | * | 10/1964 | Haining | 181/254 |
| 3,620,330 | A | * | 11/1971 | Hall | 181/266 |
| 3,894,611 | A | * | 7/1975 | Raudman, Jr. | 181/237 |
| 4,079,808 | A | * | 3/1978 | Mizuno et al. | 181/237 |
| 4,699,244 | A | * | 10/1987 | Bergquist et al. | 181/226 |
| 4,901,528 | A | * | 2/1990 | Saigo et al. | 60/312 |
| 4,903,486 | A | * | 2/1990 | Finkle | 60/324 |
| 4,916,897 | A | * | 4/1990 | Hayashi et al. | 60/286 |
| 4,971,166 | A | * | 11/1990 | Hase | 181/254 |
| 5,435,347 | A | * | 7/1995 | Gillingham | 137/599.09 |
| 5,971,098 | A | * | 10/1999 | Suzuki et al. | 181/254 |
| 5,979,596 | A | * | 11/1999 | Baker | 181/253 |
| 6,079,516 | A | * | 6/2000 | Pearson | 181/254 |
| 6,178,745 | B1 | * | 1/2001 | Meusen | 60/312 |
| 6,189,650 | B1 | * | 2/2001 | Inuzuka et al. | 181/254 |
| 6,338,246 | B2 | * | 1/2002 | Eguchi et al. | 60/324 |
| 6,546,722 | B2 | * | 4/2003 | Sagara et al. | 60/324 |

(Continued)

FOREIGN PATENT DOCUMENTS

WO WO 2007103215 A1 * 9/2007

*Primary Examiner* — Edgardo San Martin
(74) *Attorney, Agent, or Firm* — Berenato & White, LLC

(57) ABSTRACT

A high-performance muffler assembly for exhaust system of an internal combustion engine. The muffler assembly comprises an elongated casing having an inlet port and an exit port, a first pipe disposed within the casing and having an inlet end in fluid communication with the inlet port and an outlet end selectively fluidly connected to the exit port of the casing, and a first valve mounted within the casing. The first valve is selectively movable between a closed position and an open position for regulating an exhaust gas flow through the first pipe. The muffler assembly is operable in a number of different modes of operation including a high-performance mode, an exhaust braking mode, a reverse-flow mode, etc., determined by the positions of the first valve of the muffler assembly.

20 Claims, 19 Drawing Sheets

U.S. PATENT DOCUMENTS 6,564,902 B1 * 5/2003 Saberi ..... 181/237
6,598,390 B2 * 7/2003 Chang ..... 60/323
6,637,545 B1 * 10/2003 Jonsson et al. ..... 181/237
6,729,123 B2 * 5/2004 Tamura et al. ..... 60/285
6,817,172 B2 * 11/2004 Tamura ..... 60/285
6,899,199 B2 * 5/2005 Sageman ..... 181/237
7,182,171 B2 * 2/2007 Weinert et al. ..... 181/237
7,240,768 B2 * 7/2007 Sageman ..... 181/237
7,275,367 B2 * 10/2007 Tamura et al. ..... 60/324
7,325,651 B2 * 2/2008 Kikuchi et al. ..... 181/237
7,337,609 B2 * 3/2008 Mahnken et al. ..... 60/297
7,380,638 B2 * 6/2008 Willey ..... 181/254
7,451,854 B2 * 11/2008 Suzuki et al. ..... 181/237
7,506,723 B2 * 3/2009 Hoerr et al. ..... 181/250
7,673,720 B2 * 3/2010 Meneely et al. ..... 181/254
7,753,168 B2 * 7/2010 Hara et al. ..... 181/254
2004/0065503 A1 * 4/2004 Uegane et al. ..... 181/237
2004/0240677 A1 * 12/2004 Onishi et al. ..... 381/71.4
2005/0155816 A1 * 7/2005 Alcini et al. ..... 181/237
2006/0236973 A1 * 10/2006 Seibt et al. ..... 123/198 E
2006/0249328 A1 * 11/2006 Ichikawa et al. ..... 181/254
2007/0080020 A1 * 4/2007 Emmett ..... 181/237
2009/0038303 A1 * 2/2009 Takeuchi et al. ..... 60/324
2009/0107131 A1 * 4/2009 Takeuchi et al. ..... 60/324
2009/0229913 A1 * 9/2009 Tonietto et al. ..... 181/254

* cited by examiner

HIGH-PERFORMANCE MUFFLER ASSEMBLY WITH MULTIPLE MODES OF OPERATION

CROSS-REFERENCE TO RELATED APPLICATION AND CLAIM TO PRIORITY

This Application claims the benefit under 35 U.S.C. 119(e) of U.S. Application Ser. No. 11/713,106 filed Mar. 2, 2007, which claims benefit of U.S. Provisional Application No. 60/778,111 filed Mar. 2, 2006 by Meneely, V. et al.

BACKGROUND OF THE INVENTION

1. Field of the Invention

The present invention relates to mufflers for internal combustion engines in general, and, more particularly, to a high-performance muffler assembly including at least one valve assembly.

2. Description of the Prior Art

Typically, exhaust systems of internal combustion engines of all motor vehicles are equipped with a muffler for noise attenuation of the gases released from a combustion chamber of the internal combustion engines. Also, for internal combustion engines, especially diesel engines of large trucks, engine braking is an important feature for enhanced vehicle safety. For this reason, diesel engines in vehicles, particularly large trucks, are commonly equipped with an exhaust brake device for engine retarding. Exhaust brakes can be used on engines where compression release engine braking imparts too great of a load for the valve train. The exhaust brake device is characterized by increased sound level during engine braking operation.

The exhaust brake device consists of a restrictor element, such as a butterfly valve, mounted in the exhaust system upstream of a muffler. When this restrictor is closed, increasing exhaust backpressure resists the exit of gases during the exhaust cycle and provides a braking mode of operation. This system provides less braking power than a compression release engine brake, but also at less cost. With conventional fixed orifice exhaust brakes, the retarding power of an exhaust brake falls off sharply as engine speed decreases. This occurs because the restriction is typically optimized to generate maximum allowable backpressure at maximum engine speed. The optimized restriction is too large to be effective with the lower mass flow rates encountered at low engine speeds. In other words, the restriction is simply insufficient to be effective at the low engine speeds.

Typically, a range of engine operating speeds includes a low engine speed range (low engine speeds) and a high engine speed range (high engine speeds). Generally, the low engine speed range is defined as a speed range from an idle speed to a midrange speed, and high engine speed is defined as a speed range from the midrange speed to a maximum engine speed. In other words, the low engine speed is the engine speed at or near the lower end of the operating speed range of the engine, while the high engine speed is the engine speed at or near the upper end of the operating speed range of the engine.

While known exhaust systems of the internal combustion engines, including but not limited to those discussed above have proven to be acceptable for various vehicular applications, such devices are nevertheless susceptible to improvements that may enhance their performance.

SUMMARY OF THE INVENTION

The present invention provides a novel muffler assembly for an exhaust system of an internal combustion engine. The muffler assembly of the present invention comprises an elongated casing having an inlet port and an exit port, a first pipe disposed within the casing and having an inlet end in fluid communication with the inlet port and an outlet end selectively fluidly connected to the exit port of the casing, and a first valve mounted within the casing. The first valve is selectively movable between a closed position and an open position for regulating an exhaust gas flow through the first pipe. The muffler assembly is operable in a number of different modes of operation including a high-performance mode, an exhaust braking mode, a reverse-flow mode, etc., determined by the positions of the first valve of the muffler assembly.

According to a first exemplary embodiment of the present invention, the muffler assembly further comprises a pressure relief valve disposed inside the muffler casing upstream of the first valve and a second valve mounted within the muffler casing downstream of the first valve. The pressure relief valve is selectively movable between a closed position and an open position for selectively fluidly connecting the inlet end of the first pipe to the exit port by bypassing the first valve. The pressure relief valve moves into the open position when a pressure of exhaust gas acting on the pressure relief valve is higher than a predetermined value. The second valve is selectively movable between a closed position and an open position for preventing the exhaust gas flow through the outlet end of the first pipe when the second valve is in the closed position. The muffler assembly further comprises second and third pipes disposed within the casing and radially spaced from the first pipe, and first, second and third baffle plates dividing an internal cavity within the casing into a resonant chamber, an inlet chamber and a reverse-flow chamber. The muffler assembly of the first exemplary embodiment of the present invention is operable in a straight flow mode when both the first and second valves are in the open position, in an exhaust braking mode when both the first and second valves are in the closed position, in a reverse flow mode when the first valve is in the open position and the second valve is in the closed position, and in a warm-up mode during a cold start of the internal combustion engine when the first valve is in the closed position and the second valve is in the open position.

According to a second exemplary embodiment of the present invention, the muffler assembly further comprises a particulate filter disposed within the muffler casing. Preferably, the particulate filter is disposed downstream of the inlet end of the first pipe. The muffler assembly further includes at least one heating element activated when the muffler assembly operates in a regeneration mode for regenerating the particulate filter.

According to a third exemplary embodiment of the present invention, the muffler assembly further comprises second and third pipes disposed within the casing and radially spaced from the first pipe, and first, second and third baffle plates dividing an internal cavity within the casing into a resonant chamber, an inlet chamber and a reverse-flow chamber. The muffler assembly of the third exemplary embodiment of the present invention is operable in a straight flow mode when the first valve is in the open position and in a reverse flow mode when the first valve is in the closed position.

According to a fourth exemplary embodiment of the present invention, the muffler assembly further comprises a pressure relief valve disposed inside the muffler casing upstream of the first valve and a second valve mounted within the muffler casing downstream of the first valve. The pressure relief valve is selectively movable between a closed position and an open position for selectively fluidly connecting the inlet end of the first pipe to the exit port by bypassing the first valve. The pressure relief valve moves into the open position when a pressure of exhaust gas acting on the pressure relief valve is higher than a predetermined value. The second valve is selectively movable between a closed position and an open position for preventing the exhaust gas flow through the outlet end of the first pipe when the second valve is in the closed position. The muffler assembly further comprises first and second perforated baffle plates defining a resonant chamber between the first perforated baffle plate and the rear wall of the casing, an inlet chamber between the second perforated baffle plate and the front wall, and a central chamber therebetween. The first pipe further includes at least one aperture positioned between the first perforated baffle plate and the rear wall of the casing downstream of the second valve so as to provide fluid communication between the resonant chamber and the exit port through the outlet end of the first pipe, and at least one aperture positioned between the first and second valves so as to provide fluid communication between the central chamber and the first pipe between the first and second valves. The muffler assembly of the fourth exemplary embodiment of the present invention is operable in a straight flow mode when both the first and second valves are in the open position, in an exhaust braking mode when both the first and second valves are in the closed position, and in a bypass mode when the first valve is in the open position and the second valve is in the closed position.

According to a fifth exemplary embodiment of the present invention, the muffler assembly further comprises a perforated baffle plate defining a resonant chamber between the perforated baffle plate and the rear wall of the casing, and an inlet chamber between the first perforated baffle plate and the front wall. The first pipe further includes at least one aperture positioned between the first perforated baffle plate and the rear wall of the casing downstream of the first valve so as to provide fluid communication between the resonant chamber and the exit port through the outlet end of the first pipe, and at least one aperture positioned upstream of the first valve so as to provide fluid communication between the inlet chamber and the first pipe. The muffler assembly of the fifth exemplary embodiment of the present invention is operable in a straight flow mode when the first valve is in the open position and in a bypass mode when the first valve is in the closed position.

According to a sixth exemplary embodiment of the present invention, the muffler assembly further comprises a pressure relief valve disposed inside the muffler casing upstream of the first valve. The pressure relief valve is selectively movable between a closed position and an open position for selectively fluidly connecting the inlet end of the first pipe to the exit port by bypassing the first valve. The pressure relief valve moves into the open position when a pressure of exhaust gas acting on the pressure relief valve is higher than a predetermined value. The muffler assembly further comprises a perforated baffle plate defining a resonant chamber and an inlet chamber so that the inlet end of the first pipe is fluidly connected to the inlet chamber when the pressure relief valve in the open position. Moreover, the first pipe further includes at least one aperture positioned between the perforated baffle plate and a rear wall of the casing downstream of the first valve so as to provide fluid communication between the resonant chamber and the exit port through the outlet end of the first pipe. The muffler assembly of the sixth exemplary embodiment of the present invention is operable in the exhaust braking mode when the first valve is in the closed position, and in a straight flow mode when the first valve is in the open position.

According to a seventh exemplary embodiment of the present invention, the outlet end of the first pipe is closed and the muffler assembly further comprises a pressure relief valve disposed inside the muffler casing upstream of the first valve. The pressure relief valve is selectively movable between a closed position and an open position for selectively fluidly connecting the inlet end of the first pipe to the exit port by bypassing the first valve. The pressure relief valve moves into the open position when a pressure of exhaust gas acting on the pressure relief valve is higher than a predetermined value. The muffler assembly further comprises second and third pipes disposed within the casing and radially spaced from the first pipe, and first, second and third baffle plates dividing an internal cavity within the casing into a resonant chamber, an inlet chamber and a reverse-flow chamber. The muffler assembly of the seventh exemplary embodiment of the present invention is operable in an exhaust braking mode when the first valve is in the closed position and in a reverse flow mode when the first valve is in the open position.

According to an eighth exemplary embodiment of the present invention, the muffler assembly includes only one valve assembly mounted within a casing, and that a first pipe is centrally located within a second pipe which, in turn, is centrally located within the casing and extending substantially coaxially to a central axis of the casing between inlet and exit ports and thereof. The second pipe has a front perforated section adjacent to the front of the casing, a rear open section adjacent to the rear wall of the casing and a central section extending between the front and rear sections of the second pipe. The central section of the second pipe is impervious for exhaust gas flow. The muffler assembly 710 further comprises a baffle plate dividing the internal cavity within the muffler casing so as to define a resonant chamber and an inlet chamber. The baffle plate has one or more apertures so as to provide fluid communication between the inlet chamber and the resonant chamber. The muffler assembly further comprises one or more baffle members in the resonant chamber between the casing and the second pipe. The baffle members define a tortuous path of the exhaust gas flow through the resonant chamber. Preferably, the muffler assembly comprises a plurality of the baffle members each of the baffle members is in the form of a semi-annular plate disposed opposite to each other in an alternating manner. The muffler assembly of the eighth exemplary embodiment of the present invention is operable in a bypass mode when the valve is in the closed position and in a high-performance mode when the valve is in the open position.

The first and second valves are operatively controlled by an electronic control unit depending on at least one operating parameter of the muffler assembly and/or the internal combustion engine.

Therefore, the muffler assembly in accordance with the present invention allows for multiple modes of operation in order to improve and optimize operational characteristics of the internal combustion engine.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

Figure 1:
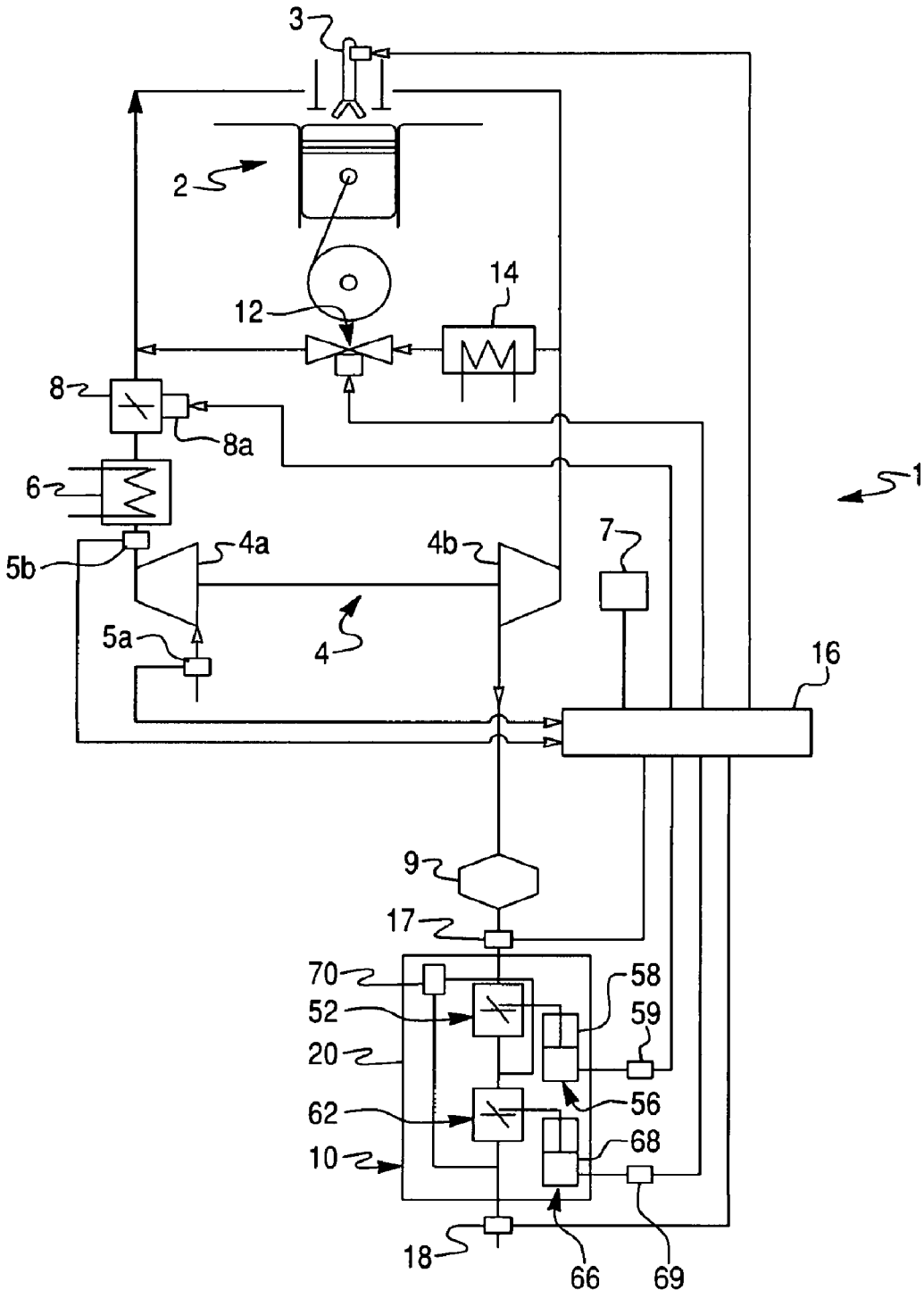
FIG. 1 is a schematic view of an exhaust system of an internal combustion engine including a muffler assembly according to a first exemplary embodiment of the present invention.

The preferred embodiments of the present invention will now be described with the reference to accompanying drawings.

For purposes of the following description, certain terminology is used in the following description for convenience only and is not limiting. The words such as "front" and "rear", "left" and "right", "inwardly" and "outwardly" designate directions in the drawings to which reference is made. The words "smaller" and "larger" refer to relative size of elements of the apparatus of the present invention and designated portions thereof. The terminology includes the words specifically mentioned above, derivatives thereof and words of similar import.

FIG. 1 schematically depicts an exhaust system 1 according to a first exemplary embodiment of the present invention provided for an internal combustion engine (ICE) 2 equipped with a turbo-charger 4. According to the preferred embodiment of the present invention, the internal combustion engine 2 is a diesel engine including a fuel injector 3. As illustrated in FIG. 1, a compressor 4*a* of the turbocharger 4 supplies intake air under pressure to a combustion chamber of the engine 2 through an intercooler 6 where the compressed charge air is cooled before entering the combustion chamber of the engine 2. Intake airflow is conventionally controlled by a throttle valve 8. An exhaust gas flow from the combustion chamber of the engine 2 flows through a turbine 4*b* of the turbocharger 4 and an oxidation catalyst 9 into a high performance muffler assembly 10 according to the first exemplary embodiment of the present invention. As further illustrated in FIG. 1, the exhaust system 1 also comprises an exhaust gas recirculation (EGR) valve 12 selectively receiving a portion of the exhaust gas flow from the ICE 2 through an EGR cooler 14 for recirculation. The fuel injector 3, the throttle valve 8 and EGR valve 12 are controlled by an electronic control unit 16 based on a one or more operating parameters of the internal combustion engine 2, such as air pressure at inlet and outlet of the compressor 4*a* of the turbocharger 4 (sensors 5*a* and 5*b*, respectively), a position of the throttle valve 8 (a throttle position sensor 8*a*), etc.

Figure 2:
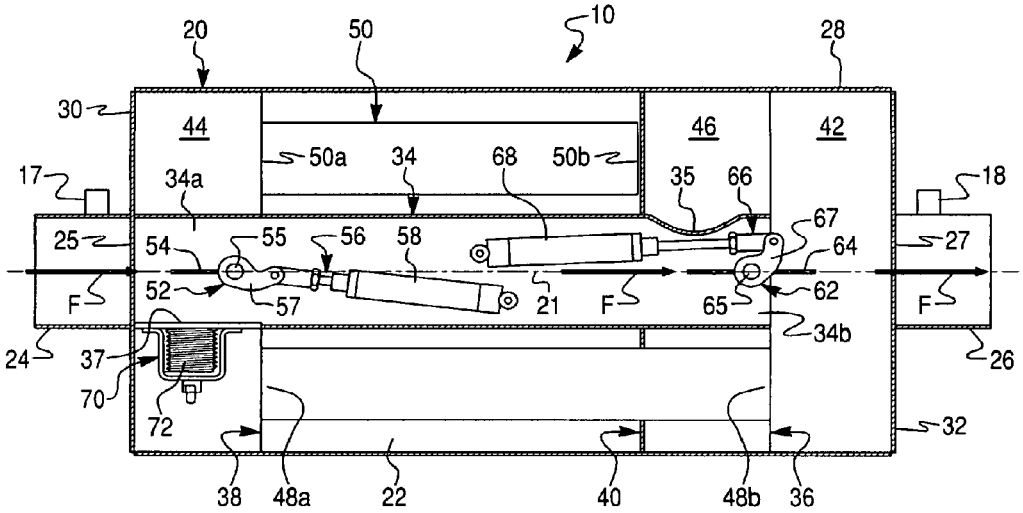
FIG. 2 is a sectional view of the muffler assembly according to the first exemplary embodiment of the present invention in a high-performance mode.

As illustrated in detail in FIG. 2, the high performance muffler assembly 10 according to the first exemplary embodiment of the present invention comprises an elongated casing (or shell) 20 defining an internal cavity 22 therein. The casing 20 is provided with an inlet pipe 24 guiding the exhaust gas flow from the ICE 2 into the casing 20 of the muffler assembly 10, and an exit pipe 26 directing the exhaust gas flow out of the casing 20 of the muffler assembly 10. Moreover, the casing 20 includes a continuous outer wall 28 extending along a central axis 21 of the casing 20, a front wall 30 and a rear wall 32. Preferably, the outer wall 28 of the casing 20 is substantially circular or elliptical in cross-section, while the front and rear walls 30, 32 are substantially planar. The inlet pipe 24 defines an inlet port 25 through the front wall 30 of the casing 20, while the exit pipe 26 defines an exit port 27 through the rear wall 32 of the casing 20. Both the inlet port 25 and exit port 27 are in fluid communication with the internal cavity 22 of the casing 20. As further illustrated in FIG. 2, the muffler assembly 10 also comprises a first pipe 34 centrally located within the casing 20 and extending substantially coaxially to the central axis 21 of the casing 20 between the inlet and exit ports 25 and 27 thereof. More specifically, the first pipe 34 has an open inlet end 34*a* attached to the inlet port 25 and an open outlet end 34*b* in fluid communication with the exit port 27 of the casing 20.

The casing 20 further includes a first, second and third baffle plates (or partition walls) 36, 38 and 40, respectively, extending across the casing 20 between the outer wall 28 thereof. The baffle plates 36, 38 and 40 are spaced from each other along the central axis 21 of the casing 20, and are axially spaced from the respective front and rear walls 30 and 32. The baffle plates 36, 38 and 40 are fixed to the outer wall 28 of the casing 20 in any appropriate manner, such as by welding. As shown in FIG. 2, the first baffle plate 36 is disposed adjacent to the outlet end 34*b* of the first pipe 34 so as to define a resonant chamber 42 within the casing 20 between the first baffle plate 36 and the rear wall 32 of the casing 20. The first baffle plate 36 has a central opening so as to provide fluid communication between the first pipe 34 and the resonant chamber 42. In other words, the outlet end 34*b* of the first pipe 34 is open to the resonant chamber 42. In turn, the resonant chamber 42 is in fluid communication with the exit port 27 of the casing 20. The second baffle plate 38 is disposed adjacent to the inlet end 34*a* of the first pipe 34 and is axially spaced from the front wall 30 so as to define a substantially annular inlet chamber 44 within the casing 20 and about the first pipe 34 between the second baffle plate 38 and the front wall 30 of the casing 20. As shown, the inlet chamber 44 is not in direct fluid communication with the inlet port 25. The second baffle plate 38 has a central opening so as to receive the first pipe 34 therethrough. The third baffle plate 40 is disposed between the inlet and outlet ends 34*a* and 34*b* of the first pipe 34 so as to define a reverse-flow chamber 46 within the casing 20 between the first baffle plate 36 and the third baffle plate 40 of the casing 20. The third baffle plate 40 has a central opening so as to receive the first pipe 34 therethrough. Thus, the first pipe 34 passes through the second and third baffle plates 38 and 40, and engages the first baffle plate 36 at the outlet end 34*b* thereof. The first pipe 34 is also provided with a bypass opening 35 adjacent to the outlet end 34*b* thereof so as to provide fluid communication between the first pipe 34 and the reverse-flow chamber 46. As illustrated, the bypass opening 35 of the first pipe 34 is open to the reverse-flow chamber 46.

The muffler assembly 10 further comprises second and third open ended pipes 48 and 50, respectively, located within the casing 20 and extending generally in the direction between the inlet and exit ports 25 and 27 thereof. Preferably, the second and third pipes 48 and 50 extend substantially parallel to the central axis 21. Moreover, the second and third pipes 48 and 50 are radially spaced from the first pipe 34. The second pipe 48 extends between the first and second baffle plates 36, 38 and passes through an opening in the third baffle plate 40 so that an inlet end 48*a* of the second pipe 48 is open to (in fluid communication with) the inlet chamber 44 through an opening in the second baffle plate 38, while an outlet end 48*b* is open to (in fluid communication with) the resonant chamber 42 through an opening 36*b* in the first baffle plate 36.

The third pipe 50 extends between the second and third baffle plates 38 and 40 so that an inlet end 50*a* of the third pipe 50 is open to (in fluid communication with) the inlet chamber 44 through an opening in the second baffle plate 38, while an outlet end 50*b* is open to (in fluid communication with) the reverse-flow chamber 46 through an opening in the third baffle plate 40. Thus, the inlet chamber 44 is in fluid communication with the resonant chamber 42 through the second pipe 48, and in fluid communication with the reverse-flow chamber 46 through the third pipe 50.

Figure 3:
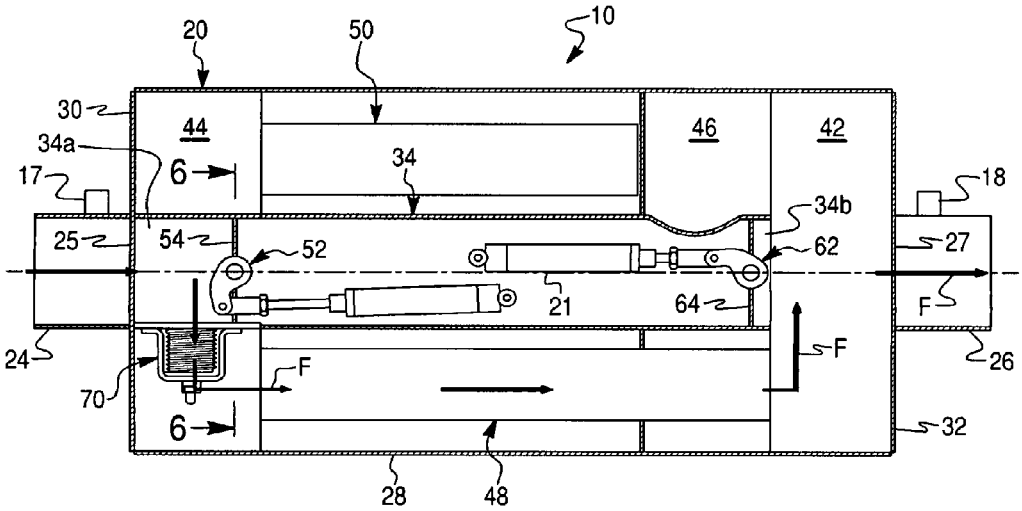
FIG. 3 is a sectional view of the muffler assembly in accordance with the first exemplary embodiment of the present invention in an exhaust braking mode.
Figure 4:
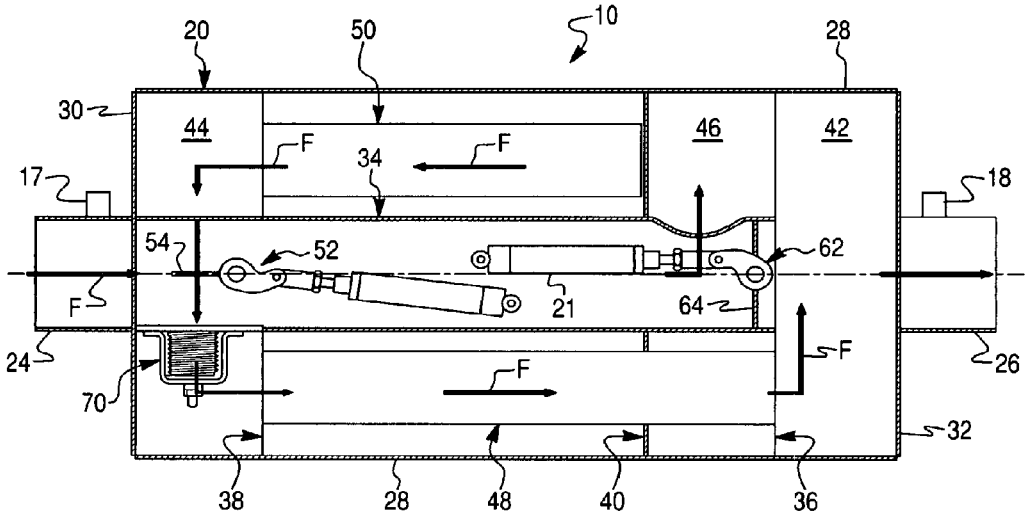
FIG. 4 is a sectional view of the muffler assembly in accordance with the first exemplary embodiment of the present invention in a reverse flow mode.
Figure 5:
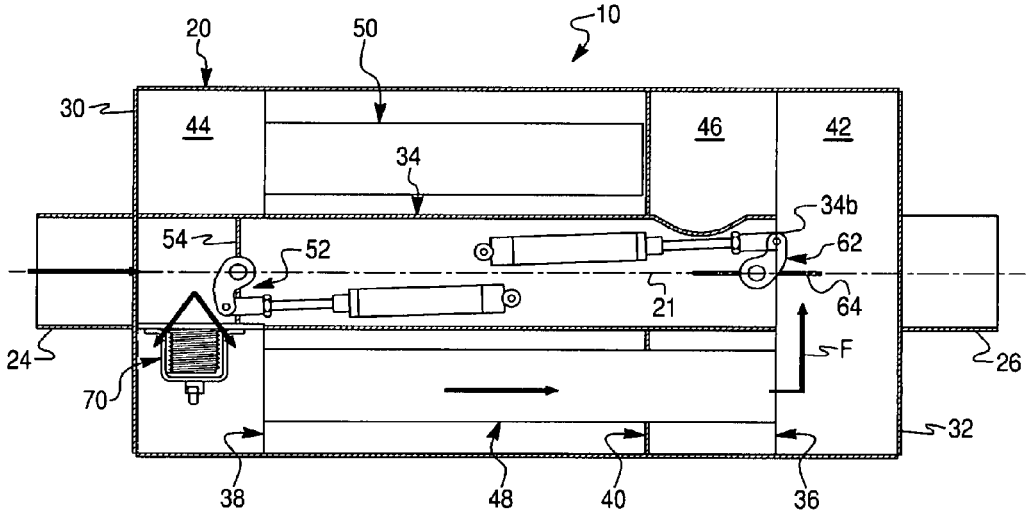
FIG. 5 is a sectional view of the muffler assembly in accordance with the first exemplary embodiment of the present invention in a warm-up mode.
Figure 6:
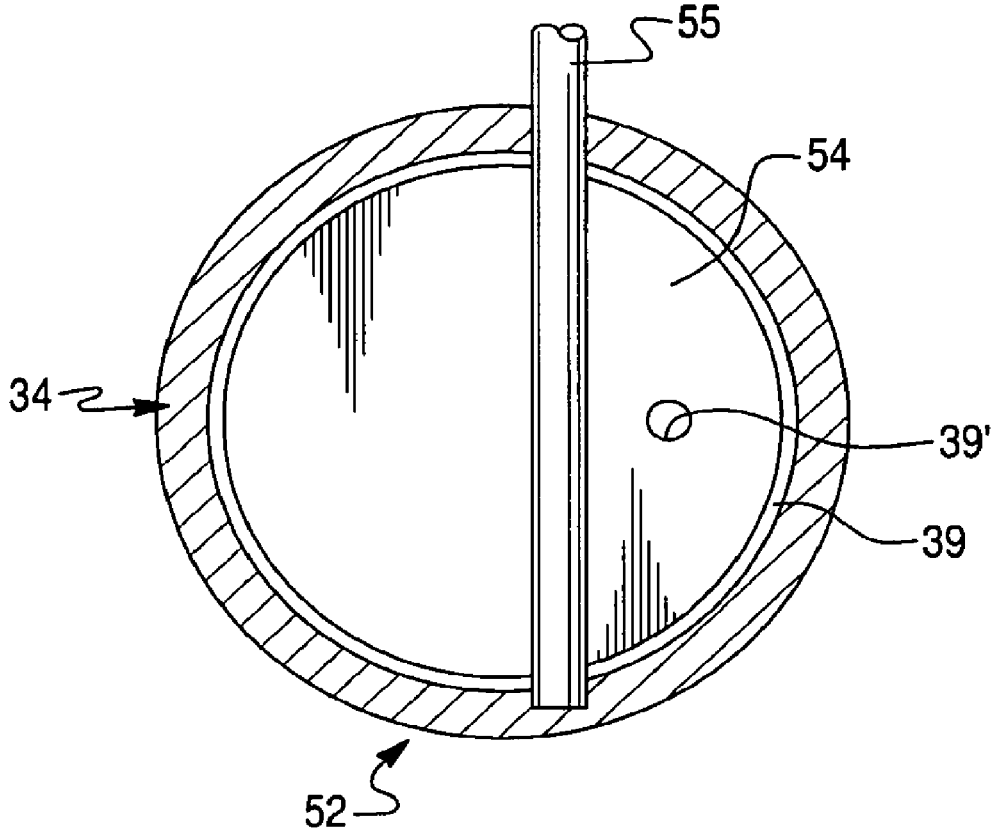
FIG. 6 is a cross-sectional view of a first valve assembly in a first pipe in a section taken along lines 6-6 in FIG. 3.

Referring now to FIGS. 1-6, the muffler assembly 10 further comprises a first valve assembly 52 mounted within the casing 20. According to the first exemplary embodiment of the present invention, the first valve assembly 52 functions as an exhaust brake device. The first valve assembly 52 includes a first valve 54 selectively movable between a closed position and an open position for regulating an exhaust gas flow through the first pipe 34. Specifically, when the first valve 54 is in the open position, as illustrated in FIGS. 2 and 4, the exhaust gas flows through the first pipe 34, while when the first valve 54 is in the closed position, as illustrated in FIGS. 3, 5 and 6, the exhaust gas is substantially prevented from flowing through the first pipe 34. Preferably, the first valve 54 is a variable valve which can adapt fully closed position, fully open position and any intermediate position between the fully open and closed positions. At the same time, an orifice is provided between the first valve and the first pipe 34 to allow some exhaust gas flow through the first pipe 34 when the first valve 54 is in the closed position.

Preferably, the first valve 54 is an exhaust restrictor in the form of a butterfly valve mounted within the first pipe 34 for rotation about a shaft 55. The first valve 54 is dimensioned so as to provide a gap (orifice) 39 (shown in FIG. 6) between an inner peripheral surface of the first pipe 34 and a circumferential edge of the first valve 54 when the first valve 54 is in its closed position, as illustrated in FIG. 6. Preferably, the gap 39 is substantially annular in shape. Alternatively, or in addition to the gap 39, the first valve 54 may also be provided with a vent opening 39' therethrough. Therefore, in its open position shown in FIGS. 2 and 4, the first butterfly valve 54 is oriented substantially parallel to the central axis 21, thereby producing only minimal resistance to the exhaust gas flow through the first pipe 34. However, in its closed position shown in FIGS. 3, 5 and 6, the first butterfly valve 54 is oriented substantially perpendicular to the central axis 21, thereby producing a maximum obstruction to the flow of the exhaust gas and therefore maximum exhaust gas backpressure. A restriction of the first valve 54 in the closed position thereof, thus the maximum exhaust gas backpressure, is determined by an area of the gap 39 around the first valve 54 and/or the optional vent opening 39' therethrough. Further preferably, the first valve 54 is disposed adjacent to the inlet end 34*a* of the first pipe 34 but is axially spaced from the inlet port 25 of the casing 20.

The first valve assembly 52 further includes a first actuator 56 provided for selectively moving the first valve 54 between the closed and open positions. It will be appreciated that the first actuator 56 may be in the form any appropriate device adapted for rotating the first valve 54 about the shaft 55. Preferably, the first actuator 56 includes an actuator lever 57 and an actuator cylinder 58. In a manner well know to those skilled in the art, a movable distal end of the actuator cylinder 58 is secured to a free end of the actuator lever 57 and can be actuated by the ECU 16. In other words, the ECU 16 operatively controls the first valve assembly 52 depending on one or more operating parameters of the internal combustion engine 2 and/or the muffler assembly 10, including engine speed and inlet and outlet exhaust gas pressure monitored by an engine speed sensor 7, schematically depicted in FIG. 1, and pressure sensors 17 and 18, respectively, shown in FIGS.

1 and 2. As illustrated in FIGS. 1 and 2, the exhaust gas inlet pressure sensor 17 is mounted to the inlet pipe 24 of the casing 20 adjacent to the inlet port 25 to monitor an inlet pressure of the exhaust gas entering the muffler assembly 10, while exhaust gas outlet pressure sensor 18 is mounted to the exit pipe 26 of the casing 20 adjacent to the exit port 27 to monitor an outlet pressure of the exhaust gas exiting the muffler assembly 10. Alternatively, the pressure sensors 17 and 18 could be mounted directly to the muffler casing 20. Both the inlet and outlet exhaust gas pressure sensors 17 and 18 are electronically connected to the ECU 16. Preferably, the actuator cylinder 58 is fluidly (e.g., pneumatically, hydraulically or vacuum) actuated by the ECU 16 through a solenoid valve 59 (shown in FIG. 1), and is disposed outside the first pipe 34. Alternatively, the first actuator 56 may be in the form of an electro-mechanical actuator or an electro-magnetic actuator.

Referring again to FIGS. 1-6, the muffler assembly 10 further comprises a second valve assembly 62 mounted within the casing 20. According to the first exemplary embodiment of the present invention, the second valve assembly 62 functions as a diverter valve. Preferably, the second valve assembly 62 is substantially structurally similar to the first valve assembly 52 and includes a second valve 64 selectively movable between a closed position and an open position for preventing the exhaust gas flow through the outlet end 34*b* of the first pipe 34 when the second valve 64 is in the closed position. Specifically, when the second valve 64 is in the open position, as illustrated in FIGS. 2 and 4, the exhaust gas can flow out the first pipe 34, while when the second valve 64 is in the closed position, as illustrated in FIGS. 3, 5 and 6, the exhaust gas is prevented from flowing through the outlet end 34*b* of the first pipe 34. The second valve 64 is mounted within the first pipe 34 downstream of the first valve 54. Preferably, the second valve assembly 62 is structurally substantially similar to the first valve assembly 52. In the preferred embodiment, the second valve 64 is a variable exhaust restrictor in the form of butterfly valve mounted within the first pipe 34 for rotation about a shaft 65. Further preferably, the second valve 64 is disposed adjacent to the outlet end 34*b* of the first pipe 34.

The second valve assembly 62 further includes a second actuator 66 provided for selectively moving the second valve 64 between the closed and open positions. It will be appreciated that the second actuator 66 may be in the form any appropriate device adapted for rotating the second valve 64 about the shaft 65. Preferably, the second actuator 66 includes an actuator lever 67 and an actuator cylinder 68. In a manner well know to those skilled in the art, a movable distal end of the actuator cylinder 68 is secured to a free end of the actuator lever 67 and can be actuated by the ECU 16. In other words, the ECU 16 operatively controls the second valve assembly 62 depending on one or more operating parameters of the internal combustion engine 2 and/or the muffler assembly 10, including engine speed and the inlet and outlet exhaust gas pressures monitored by the engine speed sensor 7 and the pressure sensors 17 and 18. Preferably, the actuator cylinder 68 is fluidly (e.g., pneumatically, hydraulically or vacuum) actuated by the ECU 16 through a solenoid valve 69 (shown in FIG. 1), and is disposed outside the first pipe 34. Alternatively, the second actuator 66 may be in the form of an electro-mechanical actuator or an electro-magnetic actuator.

The muffler assembly 10 further comprises an automatically, mechanically actuated pressure relief (or pressure regulator) valve 70 disposed inside the casing 20 upstream of the first valve 54. The pressure relief valve 70 is provided for selectively fluidly connecting the inlet end 34*a* of the first pipe 34 to the exit port 27 by bypassing the first valve 54. More specifically, the pressure relief valve 70 fluidly connects the inlet end 34*a* of the first pipe 34 to the inlet chamber 44 when the pressure in the first pipe 34 reaches a predetermined high value.

As illustrated in detail in FIGS. 2-5, the pressure relief valve 70 is mounted to the first pipe 34 adjacent to the inlet end 34*a* thereof. Preferably, the pressure relief valve 70 is normally biased in a closed position by a calibrated spring 72, and is movable between the closed position and an open position. In the normally closed position, the pressure relief valve 70 closes a relief opening 37 formed in the first pipe 34 adjacent to the inlet end 34*a* thereof so as to prevent fluid communication between the first pipe 34 and the inlet chamber 44. However, when a pressure of the exhaust gas acting on the pressure relief valve 70 is higher than a predetermined value the pressure relief valve 70 moves into the open position. In the open position, the pressure relief valve 70 opens the relief opening 37 so as to provide fluid communication between the first pipe 34 and the inlet chamber 44. It will be appreciated that the predetermined value of the exhaust gas pressure at which the pressure relief valve 70 opens depends on a spring rate of the compression spring 72. Thus, the pressure relief valve 70 could easily be tuned by calibrating the spring rate of the compression spring 72.

The muffler assembly 10 according to the first exemplary embodiment of the present invention is operable in a number of different modes of operation including a high-performance (or straight flow) mode, an exhaust braking mode, a reverse-flow mode, and a warm-up mode, determined by the positions of the first and second valve assemblies 52 and 62 of the muffler assembly 10. As described hereinabove, the first and second valve assemblies 52 and 62 of the muffler assembly 10 are selectively and independently controlled by the ECU 16 in a closed or open loop depending on one or more operating parameters of the internal combustion engine 2 and/or the muffler assembly 10, including the inlet and outlet exhaust gas pressure, and the engine speed monitored by the pressure sensors 17 and 18, and an engine speed sensor 7 schematically depicted in FIG. 1.

In the high-performance (or straight flow) mode illustrated in FIG. 2, both the first and second valves 54 and 64 are open. The exhaust gas flow freely passes directly through the first pipe 34, as denoted by directional arrows F. The direct non-restricted exhaust gas flow through the muffler assembly 10 increases the exhaust flow of the engine 2, reduces backpressure of the exhaust gas and increases efficiency of the turbocharger 4. Lower restriction in the exhaust system 1 provides better fluid exchange in the combustion chamber, therefore the power output of the engine 2 increases. Specifically, the power output of the engine 2 increases by about 4-5% when the muffler assembly 10 operates in the high-performance muffler mode. Therefore, in the high-performance mode, the muffler assembly 10 allows for a higher flow of the exhaust gas and lower exhaust gas backpressure that, in turn, allows the turbocharger and the engine 2 to breathe and function more efficiently.

In the exhaust braking mode illustrated in FIG. 3, both the first and second valves 54 and 64 are closed and the exhaust flow through the first pipe 34 is restricted. As a result, the exhaust gas back pressure is increased providing an exhaust brake function to the ICE 2, thus providing the exhaust brake function to the motor vehicle. As the engine braking mainly occurs at lower engine speeds where exhaust pressures are lower, the restriction of the first valve 54 in the closed position (e.g., the area of the orifice 39 shown in FIG. 4) is optimized to generate maximum allowable backpressure at the lower engine speeds. Thus, the optimized restriction of the first valve 54 is effective with the lower mass flow rates of the exhaust gas flow encountered at the lower engine speeds.

The exhaust gas backpressure increases generally proportionally to the engine speed. At high engine speeds the backpressure becomes higher than the maximum allowable exhaust backpressure. When the pressure of exhaust gas in the first pipe 34 acting on the pressure relief valve 70 becomes higher than a predetermined value (e.g. equal to the maximum allowable exhaust backpressure), the pressure relief valve 70 moves into its open position. Consequently, the exhaust gas flow F is forced to flow through the pressure relief valve 70 into the inlet chamber 44, then through the second pipe 48 to the resonant chamber 42, thus bypassing the first valve 54. From the resonant chamber 42 the exhaust gas exits the muffler assembly 10 through the exit port 27. Therefore, the pressure relief valve 70 is provided for selectively fluidly connecting the inlet end 34*a* of the first pipe 34 to the exit port 27 by bypassing the first valve 54 in the exhaust braking mode. The pressure relief valve 70 usually operates only at high engine speeds where the exhaust gas backpressure is higher than the maximum allowable exhaust gas backpressure. In other words, the pressure relief valve 70 is provided to limit the maximum exhaust pressure developed within the first pipe 34 of the muffler assembly 10. At higher than the maximum allowable exhaust backpressure the pressure relief valve 70 will open, controlled by the calibrated spring 72. Thus, the pressure relief valve 70 controls the exhaust gas backpressure for maximum engine braking and is used to reduce the exhaust gas backpressure during higher engine speeds to increase the exhaust gas flow of the engine for higher performance. As a result, the muffler assembly 10 of the present invention is provided to optimize the retarding power of the exhaust brake over a wider range of the engine speeds than the existing exhaust brake devices.

The exhaust brake devices are characterized by increased sound level during the exhaust brake operation. For instance, due to the restriction of the closed exhaust brake valve 54 and the pressure differential therethrough, the velocity of the exhaust gas flowing through the orifice 39 around the first valve 54 (or the vent opening 39') increases. The exhaust gas flowing at higher speed around the closed exhaust brake valve 54 has increased acoustical sound level compared to the exhaust gas flowing through an open exhaust pipe. However, as the exhaust brake device 52 is encapsulated in the casing 20 of the muffler assembly 10, the sound level generated by the restricted exhaust gas flow is reduced and contained in the muffler assembly 10. Evidently, the exhaust brake device 52 internal to the muffler assembly 10 provides a quieter exhaust brake when activated in comparison to conventional exhaust brake devices external to the muffler assemblies. Thus, being encapsulated by the muffler casing 20, the noise associated with the exhaust brake operation is significantly reduced.

In the reverse-flow mode illustrated in FIG. 4, the first (exhaust brake) valve 54 is open, while the second (diverter) valve 64 is closed. The exhaust gas flows through the first pipe 34 until reaches the closed diverter valve 64. The exhaust gas reverses its flow through the third pipe 50 and goes into the inlet chamber 44, then through the second pipe 48 to the resonant chamber 42. From the resonant chamber 42 the exhaust gas flows out of the casing 20 of the muffler assembly 10. In the reverse-flow mode, the exhaust gas flows through a longer path inside the casing 20, thus resulting in better muffling the exhaust gas noise by the muffler assembly 10.

The warm-up mode illustrated in FIG. 5, is achieved by completely or partially closing the first (exhaust brake) valve 54 (as long as the maximum backpressure of the exhaust gas during idling of the engine 2 does not exceed the predetermine value), while opening the second (diverter) valve 64 at engine idle speed. The pressure relief valve 70 will open to prevent the overpressure during engine idling. The pressure relief valve 70 works as a safety valve to prevent overpressure and provide backpressure protection. The warm-up mode of the muffler assembly 10 of the engine 2 is useful for increasing the temperature of the engine in cold conditions, especially beneficial for diesel engines. Cold operating engines affect the combustion process in the combustions chamber generating unburned hydrocarbons and increase the wear of engine components.

Moreover, if the internal combustion engine 2 operates in an engine compression release braking mode, then the second valve 64 is closed during the engine compression release braking mode.

Furthermore, the first and second valve assemblies 52 and 62 control an amount of exhaust gas recirculation used in the engine 2. The ECU 16 controls the closure of either one of the two valves 54 and 64 to obtain the desired exhaust gas recirculation for reducing the emissions of nitrogen oxides.

Figure 7:
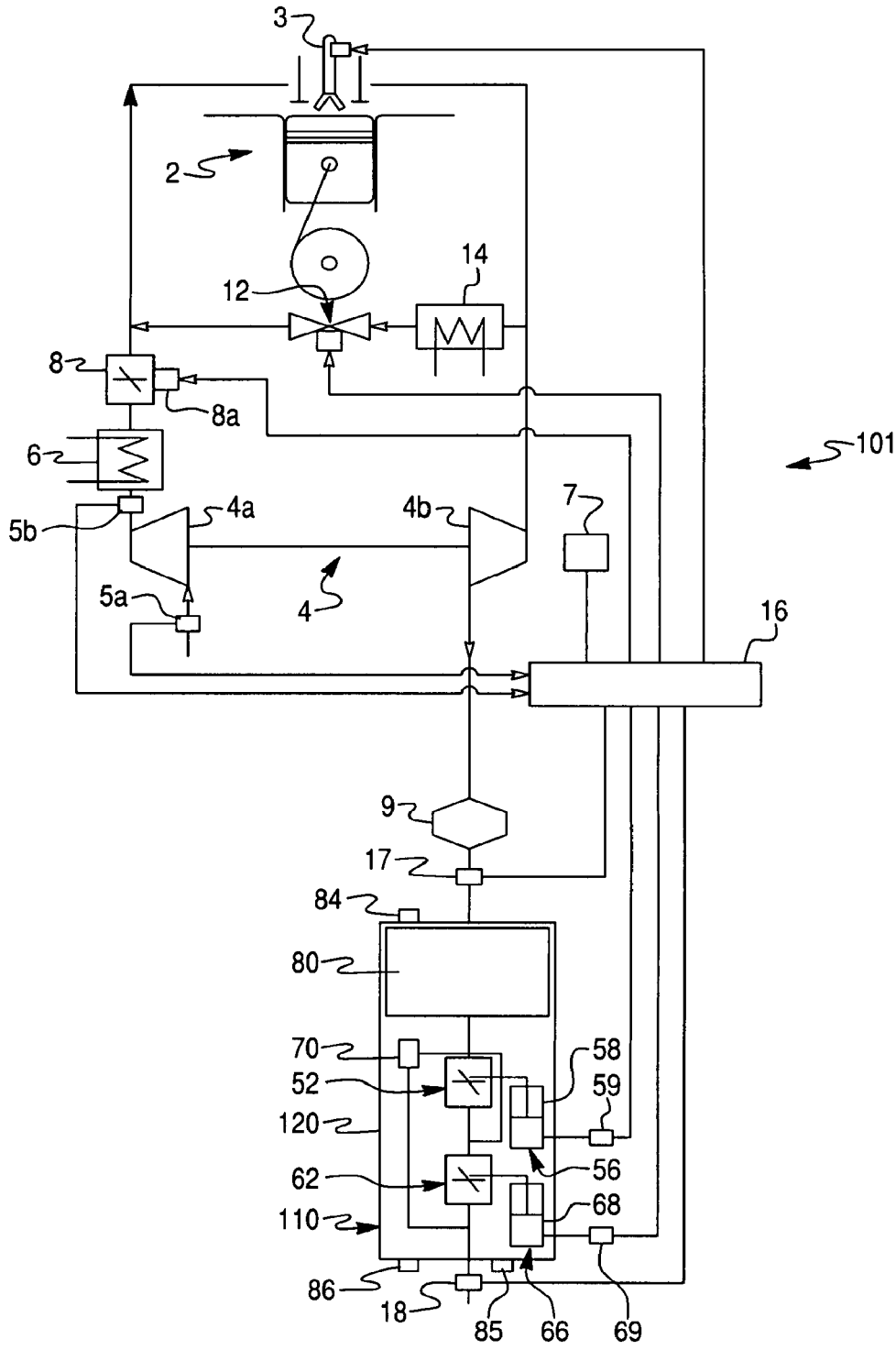
FIG. 7 is a schematic view of an exhaust system of an internal combustion engine including a muffler assembly according to a second exemplary embodiment of the present invention.
Figure 8:
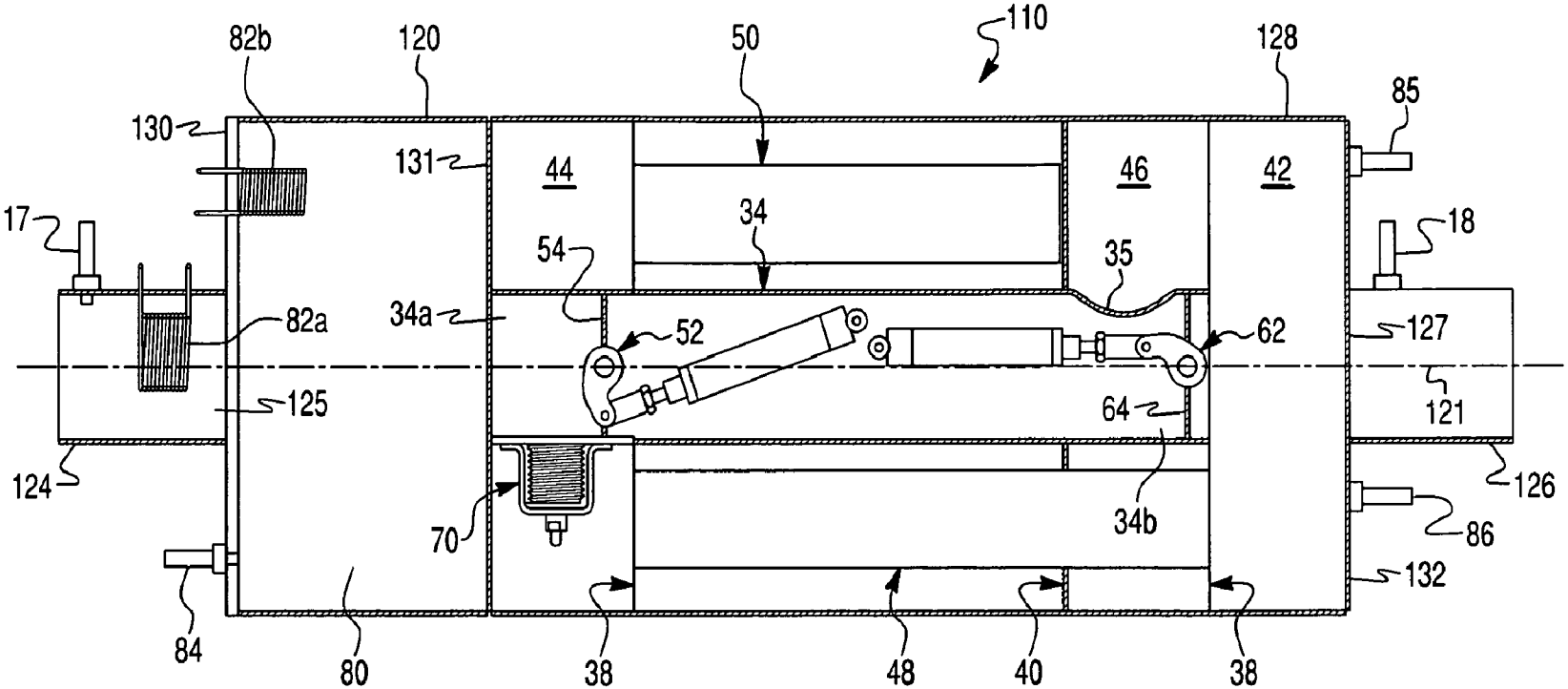
FIG. 8 is a sectional view of the muffler assembly according to the second exemplary embodiment of the present invention.

FIGS. 7 and 8 illustrate a second exemplary embodiment of a muffler assembly, generally depicted by the reference character 110. Components, which are unchanged from the first exemplary embodiment of the present invention, are labeled with the same reference characters. Components, which function in the same way as in the first exemplary embodiment of the present invention depicted in FIGS. 1-6 are designated by the same reference numerals to some of which 100 has been added, sometimes without being described in detail since similarities between the corresponding parts in the two embodiments will be readily perceived by the reader.

The muffler assembly 110 of FIGS. 7 and 8 is structurally and functionally very similar to the muffler assembly 10 of FIGS. 1-6. A difference between the muffler assembly 110 of FIGS. 7 and 8 and the muffler assembly 10 of FIGS. 1-6 is that the muffler assembly 110 additionally includes a diesel particulate filter (DPF) 80 located within a casing 120 upstream of the inlet end 34*a* of the first pipe 34. Specifically, as illustrated in FIG. 8, the DPF 80 is disposed in a cavity formed by an outer wall 128 between a front wall 130 and a filter wall 131 disposed adjacent to the inlet end 34*a* of the first pipe 34. As shown in FIG. 8, the inlet chamber 44 is defined between the filter wall 131 and the first baffle plate 36. The inlet end 34*a* of the first pipe 34 is in fluid communication with an inlet port 125 of the muffler assembly 110 through the DPF 80 so that all of the exhaust gas entering the casing 120 through the inlet port 125 flows into the inlet end 34*a* of the first pipe 34 by passing through the DPF 80. The DPF 80 is used to filter soot particles from the exhaust gas flow of the diesel engine. The DPF 80 collects particulate matter without exceeding exhaust backpressure specifications determined by an engine manufacturer.

The muffler assembly 110 according to the second exemplary embodiment of the present invention is capable of operating in a regeneration mode in order to regenerate the particulate filter 80. During operation in the regeneration mode, the temperature of the DPF 80 has to be increased for burning off the particulates trapped inside the DPF 80. Both the first and second valves 54 and 64 are closed during the particulate filter regeneration. By closing the first valve 54 the high temperature exhaust gases from the engine 2 are trapped in the DPF 80. The temperature increase of the DPF will help the regeneration process enabled by a regeneration strategy controlled by the ECU 16 shown in FIG. 7. The pressure relief valve 70 insures that the maximum exhaust gas backpressure allowable for the engine 2 is not exceeded during the regeneration process.

Preferably, in order to facilitate heating of the DPF 80, the muffler assembly 110 is provided with at least one heating element for heating exhaust gas in a regeneration mode thereof. According to the second exemplary embodiment of the present invention illustrated in FIG. 8, the muffler assembly 110 comprises a first heating element 82*a* disposed in the inlet pipe 124 upstream of the particulate filter 80, and a second heating element 82*b* disposed in the casing 120 inside the DPF 80. The heating elements 82*a* or 82*b* can be of any appropriate type, such as electrical resistance heaters. During the regeneration of the DPF 80, the heating element heats up the exhaust gas flowing into the muffler casing 20. The temperature of the particulate filter 80 has to be increased for burning off the particulates trapped inside. The first valve 54 is closed to insure that the heat from the exhaust gas flow and the heating elements 82*a* or 82*b* is contained in the DPF 80. The regeneration can be done at idle speed of the engine 2 (or during engine or exhaust braking mode).

The first and second valve assemblies 52, 62 and the heating element 82*a*, 82*b* of the muffler assembly 110 are operatively controlled by the ECU 16 in closed loop based on one or more operating parameters of the muffler assembly 110, including inlet and outlet exhaust gas pressure, acoustic frequencies generated by the muffler assembly 10, acceleration, and exhaust gas temperature. In other words, the ECU 16 controls the first and second valve assemblies 52, 62 and the heating element 82*a*, 82*b* of the muffler assembly 110 based on readings from one or more sensors installed to the muffler assembly. It will be appreciated that closed loop systems are known in the art as systems that use feed-back from sensors internal to these systems. Alternatively, the first and second valve assemblies 52, 62 and the heating element 82*a*, 82*b* of the muffler assembly 110 are operatively controlled by the ECU 16 in open loop based on one or more operating parameters of the internal combustion engine 2 and/or the muffler assembly 110.

Accordingly, as illustrated in FIGS. 7 and 8, the muffler assembly 110 comprises inlet and outlet exhaust gas pressure sensors 17 and 18, a temperature sensor 84, an accelerometer (or vibration sensor) 85 detecting vibration of the muffler assembly 110, and an acoustic sensor 86 detecting acoustic frequencies of sound waves generated by the muffler assembly 110. As further illustrated in FIGS. 7 and 8, the exhaust gas inlet pressure sensor 17 is mounted to the inlet pipe 124 of the casing 120 adjacent to inlet port 125 to monitor an inlet pressure of the exhaust gas entering the muffler assembly 110, while the exhaust gas outlet pressure sensor 18 is mounted to the exit pipe 126 of the casing 120 adjacent the exit port 127 to monitor an outlet pressure of the exhaust gas exiting the muffler assembly 110. Alternatively, the exhaust gas pressure sensors 17 and 18 can be mounted to the muffler casing 120 adjacent to the corresponding inlet and outlet ports 125 and 127, respectively, thereof. The temperature sensor 84 is mounted to the front wall 130 of the casing 120 adjacent to an inlet port 125 to monitor a temperature of the exhaust gas entering the muffler assembly 110. Alternatively, the temperature sensor 84 can be mounted to the inlet pipe 124 of the casing 120. The accelerometer 85 and the acoustic sensor 86 are mounted to the rear wall 132 of the casing 120 adjacent to an exit port 127 thereof. Alternatively, the accelerometer 85 and the acoustic sensor 86 could be mounted to the outer wall 28 of the casing 120 or to the exit pipe 126 of the casing 120.

Based on readings of the sensors 17, 18, 84, 85 and 86, the first and second valves 54 and 64 can also be controlled for various performance settings. Specifically, the ECU 16 reads the sensors 17, 18, 84, 85 and 86 from the inlet and the exit ports 125, 127 of the muffler assembly 110 and adjusts the position of the valves 54 and 64 (fully closed position, fully open position or any intermediate position between the fully open and closed positions) accordingly based on the feedback control. More specifically, the pressure readings from the inlet and outlet pressure sensors 17 and 18 allow a pressure differential across the muffler casing 120 to be determined and can be used to identify the need for DPF 80 to be regenerated (cleaned-up) or can be used for troubleshooting the muffler assembly 110 including the functioning of the first valve assembly 52 and the second valve assembly 62. Based on the pressure differential between inlet and exit ports 125 and 127, the regeneration mode of the DPF 80 can be enabled. Furthermore, the temperature reading from the temperature sensor 84 in the inlet side will modify the position of the first valve 54 and this feature can be used to control the temperature of the DPF filter 80. The vibration sensor 85 or the acoustic sensor 86 can be used to partially open or close the second valve 64 to achieve a certain noise value for the muffler (noise control).

Figure 9:
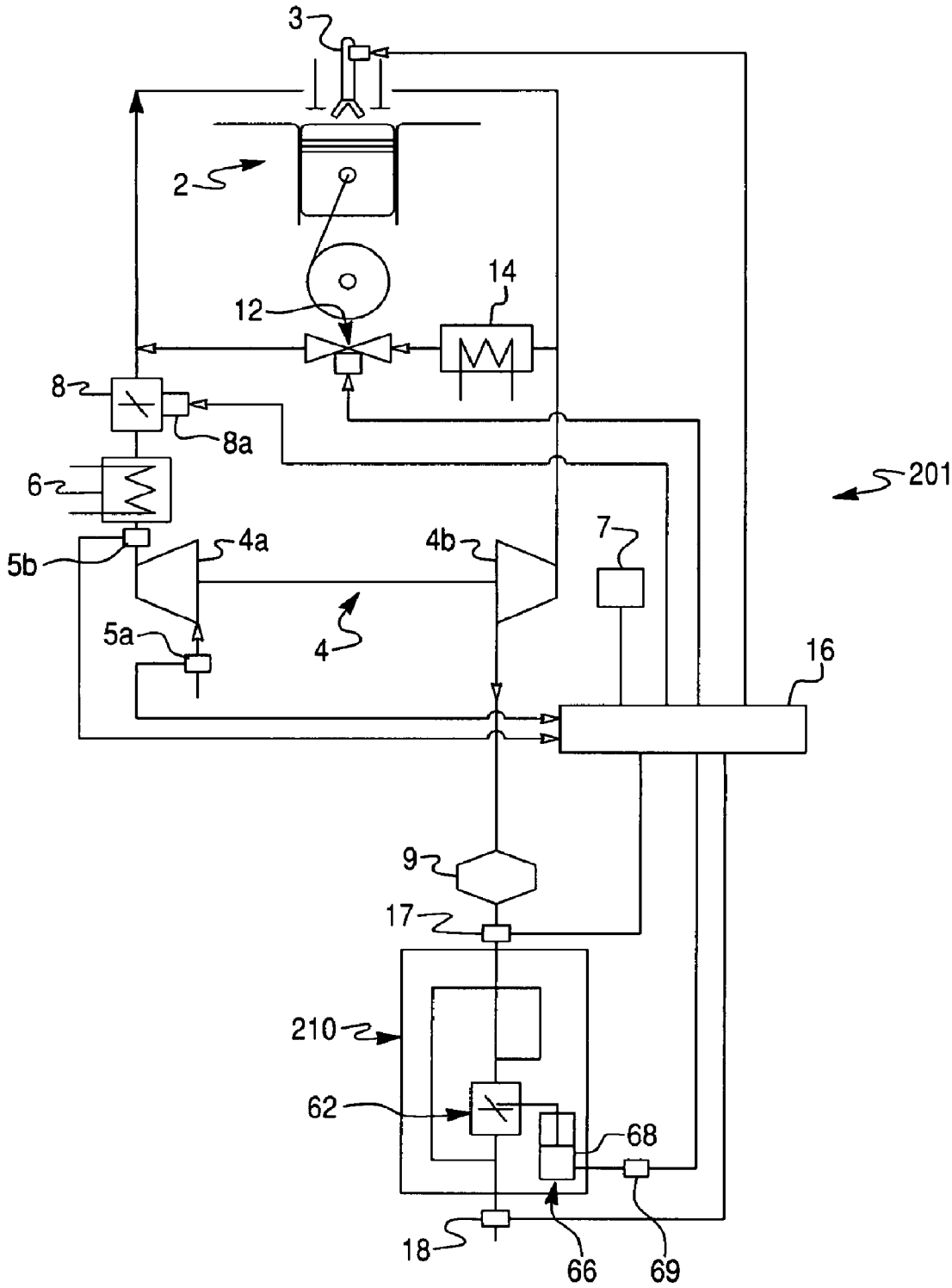
FIG. 9 is a schematic view of an exhaust system of an internal combustion engine including a muffler assembly according to a third exemplary embodiment of the present invention.
Figure 10:
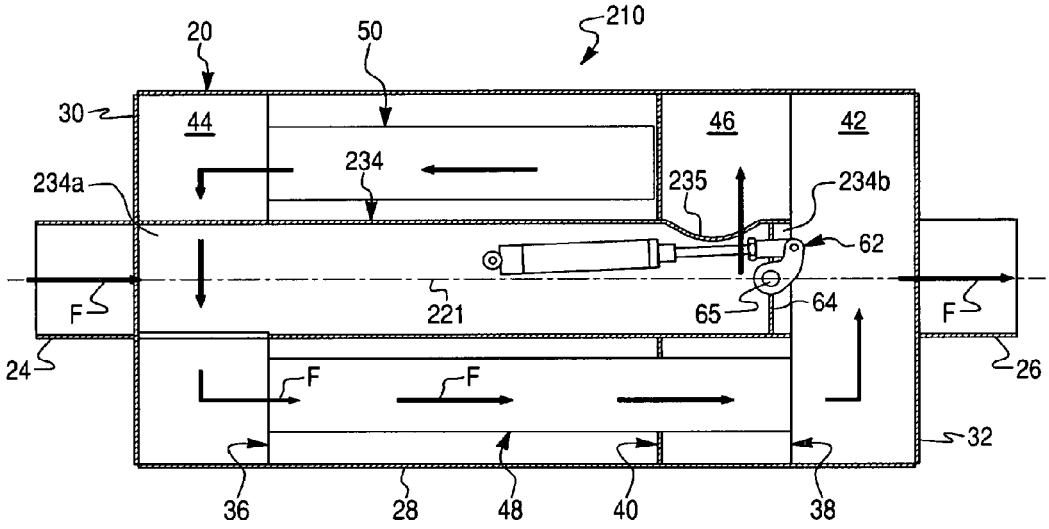
FIG. 10 is a sectional view of a muffler assembly according to the third exemplary embodiment of the present invention in a reverse flow mode.
Figure 11:
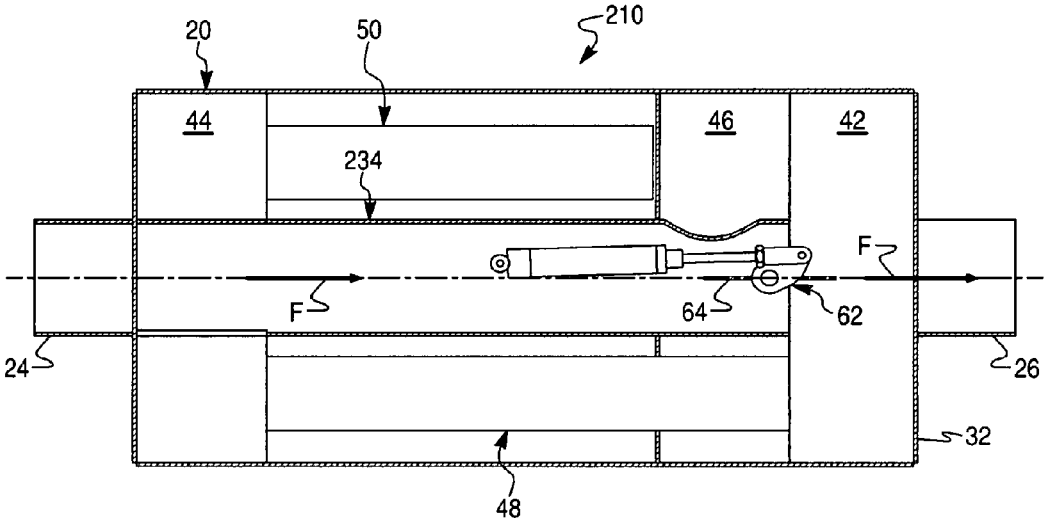
FIG. 11 is a sectional view of the muffler assembly in accordance with the third exemplary embodiment of the present invention in a high-performance mode.
Figure 12:
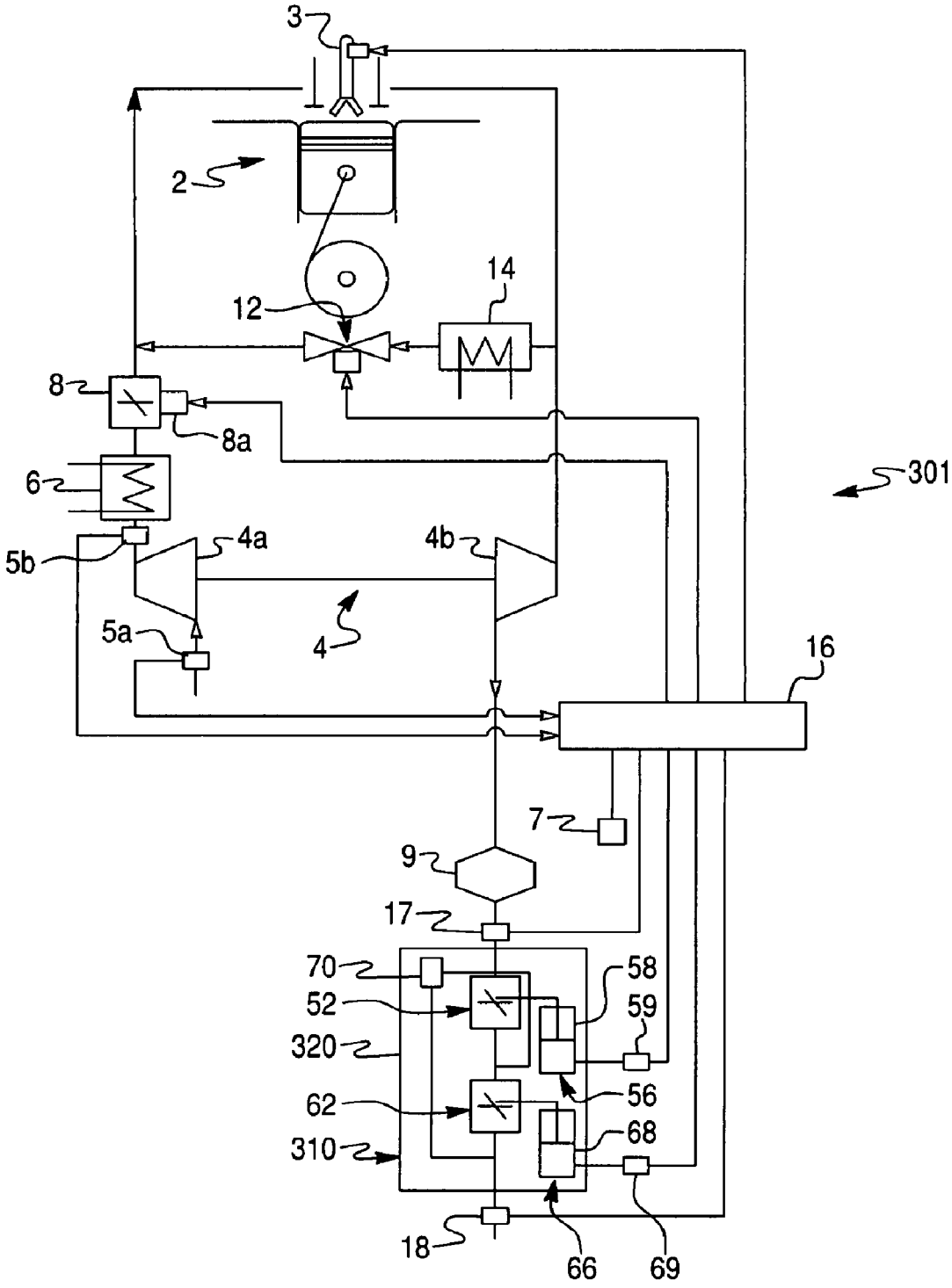
FIG. 12 is a schematic view of an exhaust system of an internal combustion engine including a muffler assembly according to a fourth exemplary embodiment of the present invention.

FIGS. 9-11 illustrate a third exemplary embodiment of a muffler assembly, generally depicted by the reference character 210. Components, which are unchanged from the first exemplary embodiment of the present invention, are labeled with the same reference characters. Components, which function in the same way as in the first exemplary embodiment of the present invention depicted in FIGS. 1-6 are designated by the same reference numerals to some of which 200 has been added, sometimes without being described in detail since similarities between the corresponding parts in the two embodiments will be readily perceived by the reader.

A difference between the muffler assembly 210 of FIGS. 9-11 and the muffler assembly 10 of FIGS. 1-6 is that in this case the muffler assembly 210 includes only one valve assembly 62 mounted within the casing 20. According to the third exemplary embodiment of the present invention, the valve assembly 62 functions as a diverter valve. The valve assembly 62 includes a diverter valve 64 selectively movable between a closed position and an open position for preventing the exhaust gas flow through an outlet end 234*b* of a first pipe 234 when the diverter valve 64 is in the closed position. Specifically, when the diverter valve 64 is in the open position, as illustrated in FIG. 11, the exhaust gas can flow out the first pipe 234, while when the diverter valve 64 is in the closed position, as illustrated in FIG. 10, the exhaust gas is prevented from flowing through the outlet end 234*b* of the first pipe 234. In the preferred embodiment, the diverter valve 64 is an exhaust restrictor in the form of butterfly valve mounted within the first pipe 234 for rotation about a shaft 65. The diverter valve 64 is disposed adjacent to the outlet end 234*b* of the first pipe 234.

The valve assembly 62 includes an actuator 66 provided for selectively moving the diverter valve 64 between the closed and open positions. The actuator 66 may be in the form any appropriate device adapted for rotating the diverter valve 64 about the shaft 65. The actuator 66 is actuated by the ECU 16. In other words, the ECU 16 operatively controls the valve assembly 62 depending on one or more operating parameters of the internal combustion engine 2 and/or the muffler assembly 10, including the inlet and outlet exhaust gas pressure.

The muffler assembly 210 according to the third exemplary embodiment of the present invention is operable in a number of different modes including a high-performance mode and a reverse-flow mode, determined by the positions of the valve assembly 262.

In the high-performance mode illustrated in FIG. 11, the second valve 64 is open. The exhaust gas flow freely passes directly through the first pipe 234, as denoted by directional arrows F. The direct non-restricted exhaust gas flow through the muffler assembly 210 increases the exhaust flow of the engine 2, reduces backpressure of the exhaust gas and increases efficiency of the turbocharger 4. Lower restriction in the exhaust system 201 provides better fluid exchange in the combustion chamber, therefore the power output of the engine 2 increases. Specifically, the power output of the engine 2 increases by about 4-5% when the muffler assembly 10 operates in the high-performance muffler mode. Therefore, in the high-performance mode, the muffler assembly 210 allows for a higher flow of the exhaust gas and lower exhaust gas backpressure that, in turn, allows the turbocharger and the engine 2 to breathe and function more efficiently.

In the reverse-flow mode illustrated in FIG. 10, the diverter valve 64 is closed. The exhaust gas flows through the first pipe 234 until it reaches the closed diverter valve 64. The exhaust gas reverses its flow through reverse-flow chamber 46 and the third pipe 50 into an inlet chamber 44, and then goes through the second pipe 48 to the resonant chamber 42. From the resonant chamber 42 the exhaust gas flows out of the casing 20 of the muffler assembly 210. In the reverse-flow mode, the exhaust gas flows through longer path inside the casing 20, thus resulting in better muffling the exhaust gas noise by the muffler assembly 210.

FIGS. 12-15 illustrate a fourth exemplary embodiment of a muffler assembly, generally depicted by the reference character 310. Components, which are unchanged from the first exemplary embodiment of the present invention, are labeled with the same reference characters. Components, which function in the same way as in the first exemplary embodiment of the present invention depicted in FIGS. 1-6 are designated by the same reference numerals to some of which 300 has been added, sometimes without being described in detail since similarities between the corresponding parts in the two embodiments will be readily perceived by the reader.

A difference between the muffler assembly 310 of FIGS. 12-15 with respect to the muffler assembly 10 of FIGS. 1-6 is that in this case the muffler assembly 310 includes a single pipe 334 mounted within the casing 320 and centrally extending between front and rear walls 330 and 332 of a muffler casing 320 substantially coaxially to a central axis 321. More specifically, the pipe 334 has an open inlet end 334*a* attached to an inlet port 325 and an open outlet end 334*b* attached to an exit port 327 of the casing 320. In other words, the inlet and outlet distal ends 334*a*, 334*b* of the pipe 334 are attached to the inlet and exit pipes 324 and 326, respectively.

Figure 13:
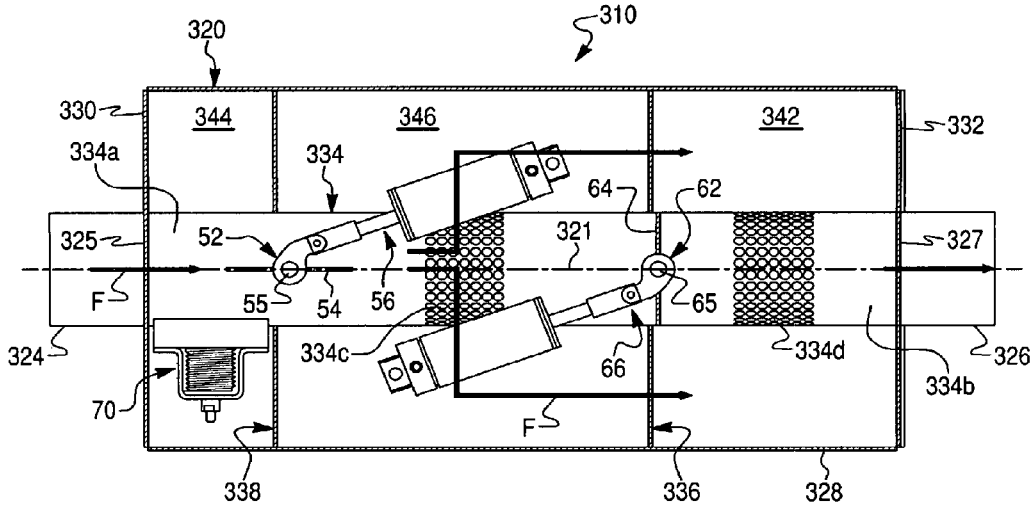
FIG. 13 is a sectional view of a muffler assembly according to the fourth exemplary embodiment of the present invention in a bypass mode.
Figure 14:
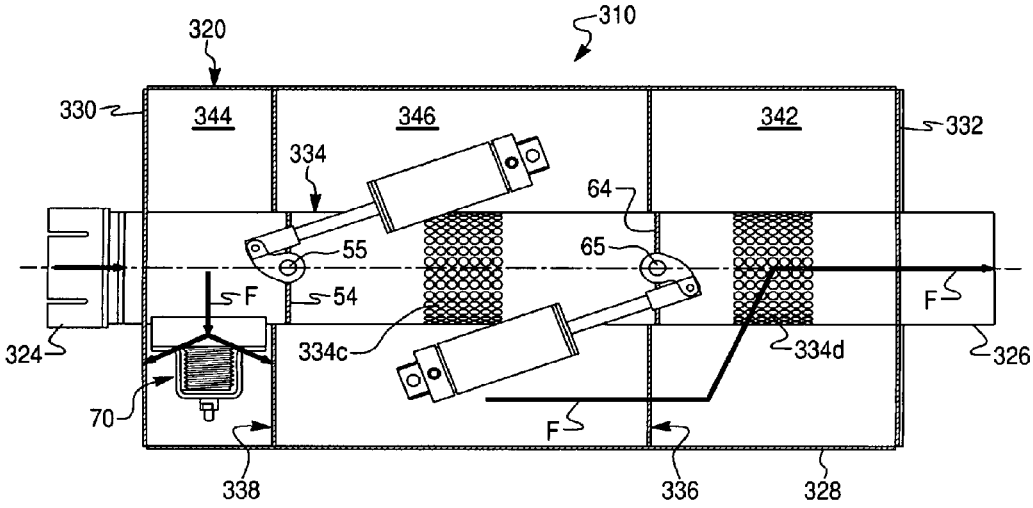
FIG. 14 is a sectional view of the muffler assembly in accordance with the fourth exemplary embodiment of the present invention in an exhaust braking mode.
Figure 15:
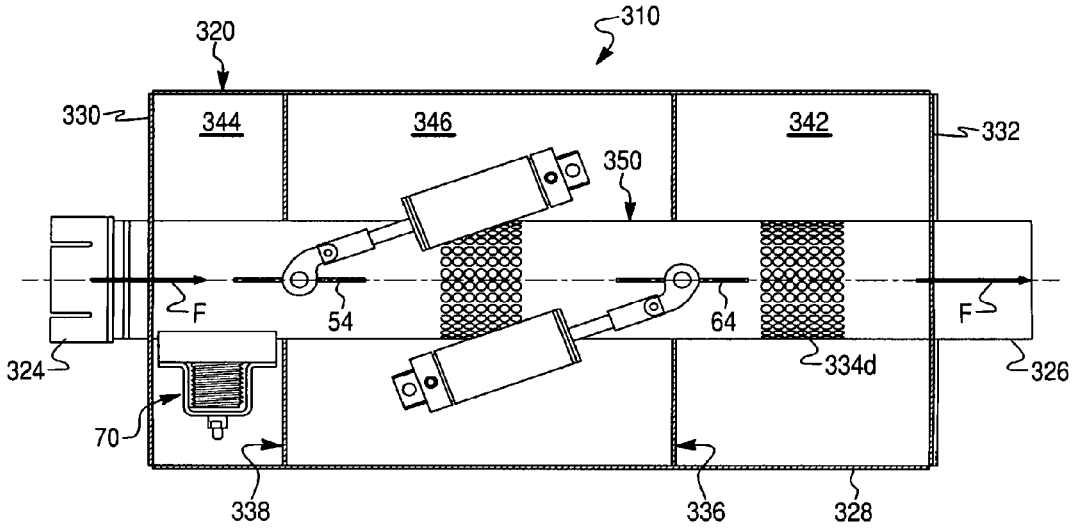
FIG. 15 is a sectional view of the muffler assembly in accordance with the fourth exemplary embodiment of the present invention in a high-performance mode.

Two perforated baffle plates 336 and 338 along with the front and rear walls 330 and 332 divide an internal cavity 322 of the casing 320 into three chambers 342, 344 and 346. As shown in FIGS. 13-15, the first baffle plate 336 is disposed adjacent to the outlet end 334*b* of the pipe 334 so as to define a first (resonant) chamber 342 within the casing 320 about the pipe 334 between the first baffle plate 336 and the rear wall 332 of the casing 320. The first baffle plate 336 has a central opening so as to receive the pipe 334 therethrough. The second baffle plate 338 is disposed adjacent to the inlet end 334*a* of the pipe 334 and is axially spaced from the front wall 330 so as to define a second (inlet) chamber 344 within the casing 320 and about the pipe 334 between the second baffle plate 338 and the front wall 330 of the casing 320. As shown, the inlet chamber 344 is not in direct fluid communication with the inlet port 325. The second baffle plate 338 has a central opening so as to receive the pipe 334 therethrough. The third (central) chamber 346 is defined within the casing 320 about the pipe 334 between the first and second baffle plates 336 and 338. Thus, the pipe 334 passes through the first and second baffle plates 336 and 338, and is connected to the inlet and exit ports 325 and 327 at the opposite ends 334*a* and 334*b* thereof.

The pipe 334 also comprises a first perforated section 334*c* positioned between the first and second baffle plates 336 and 338, and a second perforated section 334*d* positioned between the first baffle plate 336 and the rear wall 332 of the muffler casing 320. Thus, the pipe 334 is in fluid communication with the resonant chamber 342 and the central chamber 346. In other words, the outlet end 334*b* of the pipe 334 is open to the resonant chamber 342. In turn, the resonant chamber 342 is in fluid communication with the exit port 327 of the casing 320. As a result, the exhaust gasses entering the pipe 334 of the muffler casing 320 through the inlet pipe 324 can expand into the central chamber 346 between the baffle plates 336 and 338, and into the resonant chamber 342 between the first baffle plate 336 and the rear wall 332 of the muffler casing 320. The pipe 334 is also provided with a relief opening 337 disposed between the inlet end 334*a* thereof and the second baffle plate 338 so as to provide fluid communication between the pipe 334 and the inlet chamber 344.

The muffler assembly 310 further comprises a first valve assembly 52 and a second valve assembly 62 both mounted within the casing 320. Preferably, the first and second valve assemblies 52 and 62 are substantially similar.

The first valve assembly 52 functions as an exhaust brake device and includes a first valve 54 selectively movable between a closed position and an open position for regulating an exhaust gas flow through the pipe 334. Preferably, the first valve 54 is an exhaust restrictor in the form of butterfly valve mounted within the pipe 334 for rotation about a shaft 55. In its open position shown in FIGS. 13 and 15, the first butterfly valve 54 is oriented substantially parallel to a central axis 321, thereby producing only minimal resistance to the exhaust gas flow through the pipe 334. However, in its closed position shown in FIG. 14, the first butterfly valve 54 is oriented substantially perpendicular to the central axis 321, thereby producing a maximum obstruction to the flow of the exhaust gas. At the same time, an orifice is provided between the first valve 54 and the pipe 334 to allow some exhaust gas flow through the pipe 334 when the first valve 54 is in the closed position. More specifically, the first valve 54 is dimensioned so as to provide a gap (orifice) between an inner peripheral surface of the pipe 334 and a circumferential edge of the first valve 54 when the first valve 54 is in its closed position (similarly to the orifice 39 of the embodiment illustrated in FIG. 6). Preferably, the orifice is substantially annular in shape. Further preferably, the first valve 54 is disposed adjacent to the inlet end 334*a* of the pipe 334 but is axially spaced from the inlet port 325 of the casing 320. The first valve assembly 52 further includes a first actuator 56 provided for selectively moving the first valve 54 between the closed and open positions. In a manner well know to those skilled in the art, a movable distal of the actuator 56 can be actuated by the ECU 16. The first valve 54 is positioned upstream of the first perforated section 434*c*.

The second valve assembly 62 functions as a diverter device and includes a second valve 64 selectively movable between a closed position and an open position for regulating an exhaust gas flow through the pipe 334. Preferably, the second valve 64 is a restrictor in the form of butterfly valve mounted within the pipe 334 for rotation about a shaft 65. In its open position shown in FIG. 15, the second butterfly valve 64 is oriented substantially parallel to a central axis 321, thereby producing only minimal resistance to the exhaust gas flow through the pipe 334. However, in its closed position shown in FIGS. 13 and 14, the second butterfly valve 64 is oriented substantially perpendicular to the central axis 321, thereby producing a maximum obstruction to the flow of the exhaust gas and therefore maximum exhaust gas backpressure. Further preferably, the second valve 64 is disposed adjacent to the outlet end 334*b* of the pipe 334 but is axially spaced from the outlet port 327 of the casing 320. Also, the second valve 64 is disposed between the first and second perforated sections 334*c* and 334*d*. The second valve assembly 62 further includes a second actuator 66 provided for selectively moving the second valve 64 between the closed and open positions. The actuator 66 is actuated by the ECU 16. In other words, the ECU 16 operatively controls the first and second valve assemblies 52 and 62 depending on one or more operating parameters of the internal combustion engine 2 and/or the muffler assembly 310, including inlet and outlet exhaust gas pressure monitored by pressure sensors 17 and 18, respectively, shown in FIG. 12.

The muffler assembly 310 further comprises an automatically, mechanically actuated pressure relief (or pressure regulator) valve 70 disposed inside the casing 320 upstream of the first valve 54. The pressure relief valve 70 is provided for selectively fluidly connecting the inlet end 334*a* of the pipe 334 to the exit port 327 by bypassing the first valve 54. More specifically, the pressure relief valve 70 fluidly connecting the inlet end 334*a* of the pipe 334 to the inlet chamber 344 when the pressure in the pipe 334 reaches a predetermined high value.

The muffler assembly 310 according to the fourth exemplary embodiment of the present invention is operable in a number of different modes including a high-performance mode, a bypass mode, and an exhaust braking mode, determined by the positions of the first and second valve assemblies 52 and 62 of the muffler assembly 310. As described hereinabove, the first and second valve assemblies 52 and 62 of the muffler assembly 10 are selectively and independently controlled by the ECU 16 depending on one or more operating parameters of the internal combustion engine 2 and/or the muffler assembly 310, including the inlet and outlet exhaust gas pressure monitored by the pressure sensors 17 and 18.

In the exhaust braking mode illustrated in FIG. 14, both the first and second valves 54 and 64 are closed and the exhaust flow through the pipe 334 is restricted. As a result, the exhaust gas back pressure is increased providing an exhaust brake function to the ICE 2, thus providing the exhaust brake function to the motor vehicle. When the pressure of exhaust gas in the pipe 334 acting on the pressure relief valve 70 becomes higher than a predetermined value the pressure relief valve 70 moves into its open position. Consequently, the exhaust gas flow F is forced to flow through the pressure relief valve 70 into the inlet chamber 344, then through the second perforated baffle plate 338 into the central chamber 346, thus bypassing the first valve 54. From the central chamber 346 the exhaust gas flows into the resonant chamber 342 through the first perforated baffle plate 336. Then, the exhaust gas flows into the pipe 334 through the second perforated section 334*d* and exits the muffler assembly 310 through the exit port 327. Therefore, the pressure relief valve 70 is provided for selectively fluidly connecting the inlet end 334*a* of the pipe 334 to the exit port 325 by bypassing the first valve 54 in the exhaust braking mode.

In the bypass mode illustrated in FIG. 13, the first valve 54 is open, while the second valve 64 is closed. The exhaust gas passes the open first valve 54 and flows through the pipe 334 until reaches the closed second valve 64. The exhaust gas bypasses the second valve 64 and flows first into the central chamber 346 through the first perforated section 334*c*, and then through the first perforated baffle plate 336 into the resonant chamber 342. From the resonant chamber 342 the exhaust gas flows out of the muffler casing 320 through the second perforated section 334*d* and the exit port 327.

In the high-performance mode illustrated in FIG. 15, both the first and second valves 54 and 64 are open. The exhaust gas flow freely passes directly through the pipe 334, as denoted by directional arrows F. The direct non-restricted exhaust gas flow through the muffler assembly 310 increases the exhaust flow of the engine 2, reduces backpressure of the exhaust gas and increases efficiency of the turbocharger 4. Lower restriction in the exhaust system 301 provides better fluid exchange in the combustion chamber, therefore the power output of the engine 2 increases. Specifically, the power output of the engine 2 increases by about 4-5% when the muffler assembly 310 operates in the high-performance muffler mode. Therefore, in the high-performance mode, the muffler assembly 310 allows for a higher flow of the exhaust gas and lower exhaust gas backpressure that, in turn, allows the turbocharger and the engine 2 to breathe and function more efficiently.

Figure 16:
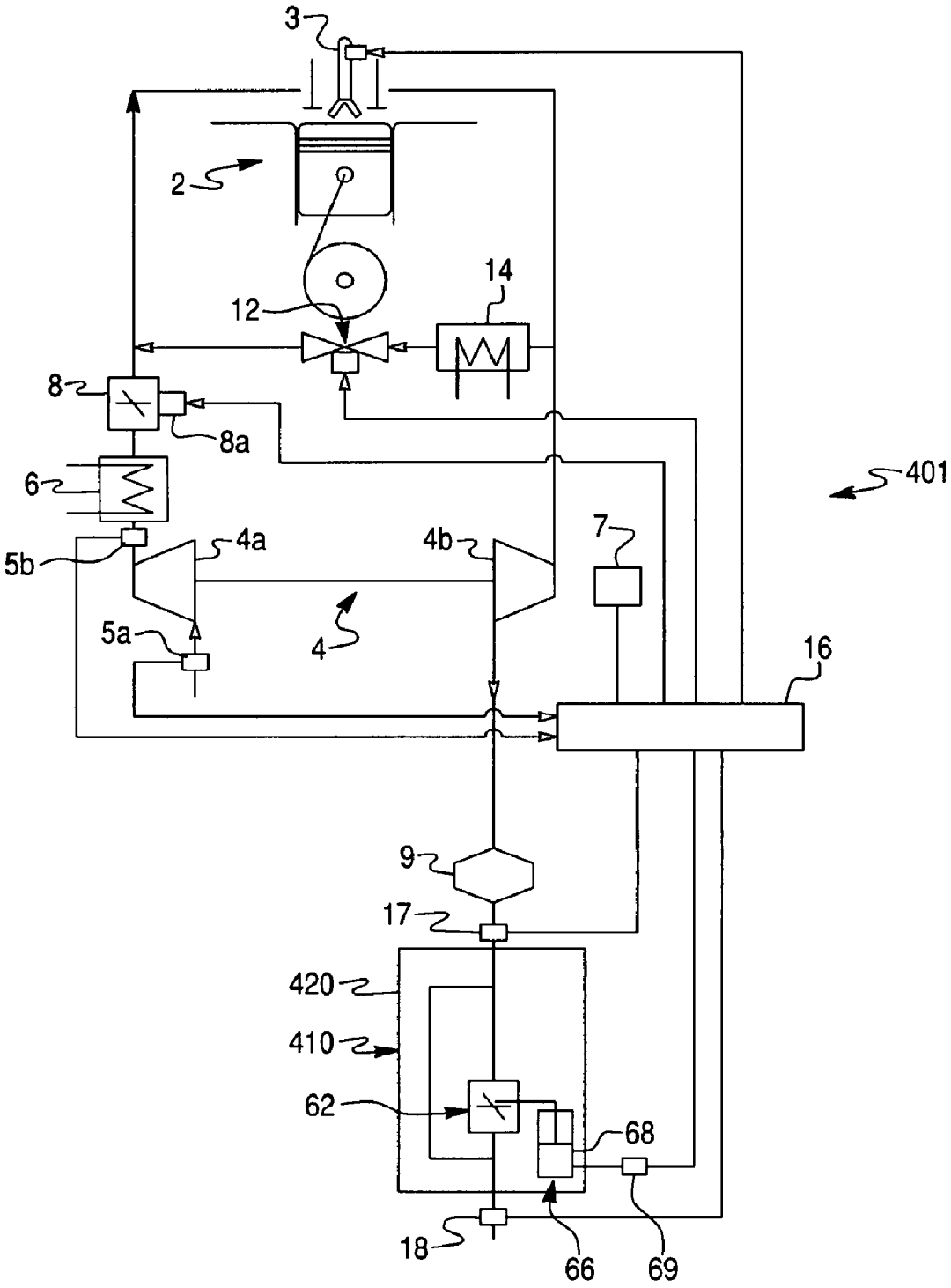
FIG. 16 is a schematic view of an exhaust system of an internal combustion engine including a muffler assembly according to a fifth exemplary embodiment of the present invention.
Figure 17:
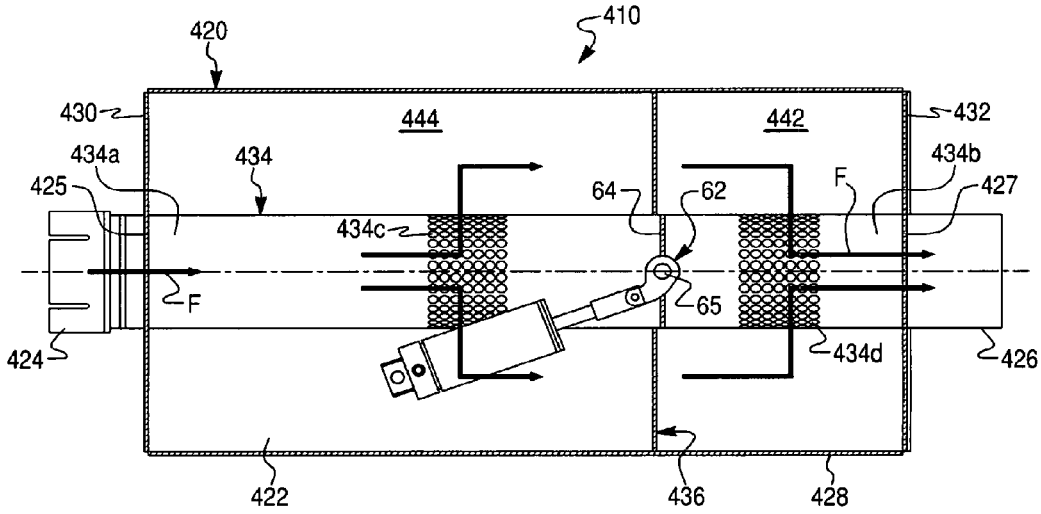
FIG. 17 is a sectional view of a muffler assembly according to the fifth exemplary embodiment of the present invention in a bypass mode.
Figure 18:
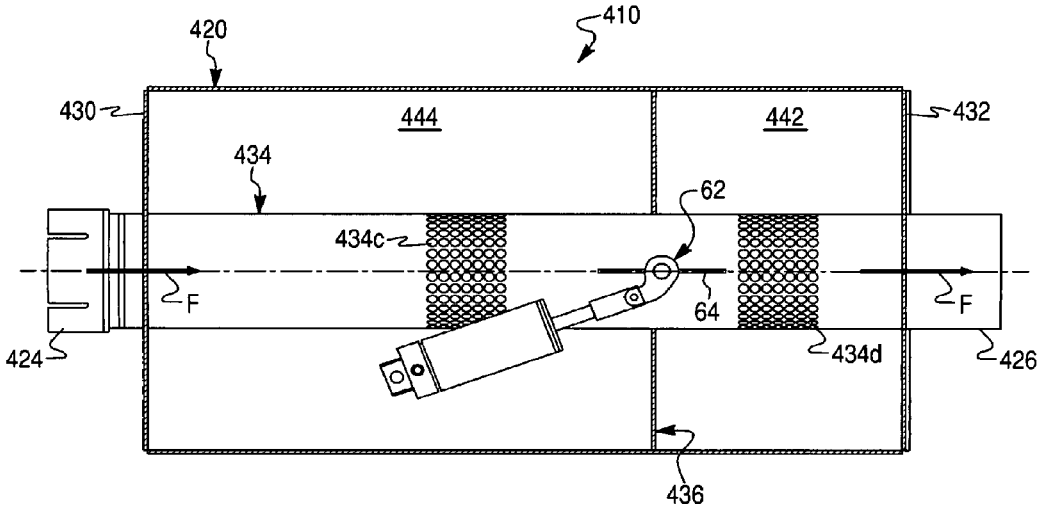
FIG. 18 is a sectional view of the muffler assembly in accordance with the fifth exemplary embodiment of the present invention in a high-performance mode.

FIGS. 16-18 illustrate a fifth exemplary embodiment of a muffler assembly, generally depicted by the reference character 410. Components, which are unchanged from the first exemplary embodiment of the present invention, are labeled with the same reference characters. Components, which function in the same way as in the first exemplary embodiment of the present invention depicted in FIGS. 1-6 are designated by the same reference numerals to some of which 400 has been added, sometimes without being described in detail since similarities between the corresponding parts in the two embodiments will be readily perceived by the reader.

A difference between the muffler assembly 410 of FIGS. 16-18 with respect to the muffler assembly 310 of FIGS. 12-15 is that the muffler assembly 410 includes only one valve assembly 62 mounted within the casing 420, only one perforated baffle plate 436, and lacks a pressure relief valve 70 mounted to a central pipe 434. According to the fifth exemplary embodiment of the present invention, the valve assembly 62 functions as a diverter valve. The valve assembly 62 includes a diverter valve 64 selectively movable between a closed position and an open position for preventing the exhaust gas flow through an outlet end 434*b* of the central pipe 434 when the diverter valve 64 is in the closed position. Specifically, when the diverter valve 64 is in the open position, as illustrated in FIG. 18, the exhaust gas can flow out the pipe 434, while when the diverter valve 64 is in the closed position, as illustrated in FIG. 17, the exhaust gas is prevented from flowing through the outlet end 434*b* of the pipe 434. In the preferred embodiment, the diverter valve 64 is in the form of butterfly valve mounted within the pipe 434 for rotation about a shaft 65. The diverter valve 64 is disposed adjacent to the outlet end 434*b* of the pipe 434.

The perforated baffle plate 436 divides an internal cavity 422 of the casing 420 into two chambers 442 and 444. A first (resonant) chamber 442 is defined within the casing 420 about the pipe 434 between the baffle plate 436 and a rear wall 432 of the casing 420. The baffle plate 436 has a central opening so as to receive the pipe 434 therethrough. A second (inlet) chamber 444 is defined within the casing 420 and about the pipe 434 between the baffle plate 436 and a front wall 430 of the casing 420. The inlet chamber 444 is in fluid communication with the resonant chamber 442 through the perforated baffle plate 436.

The pipe 434 also comprises a first perforated section 434*c* positioned between the front wall 430 of the muffler casing 420 and the baffle plate 436, and a second perforated section 434*d* positioned between the baffle plate 436 and the rear wall 432 of the muffler casing 420. In other words, the first perforated section 434*c* is positioned upstream of the diverter valve 64, while the second perforated section 434*d* is positioned downstream of the diverter valve 64. Thus, the pipe 434 is in fluid communication with the resonant chamber 442 and the inlet chamber 444. In other words, the outlet end 434*b* of the pipe 434 is open to the resonant chamber 442. In turn, the resonant chamber 442 is in fluid communication with the exit port 427 of the casing 420. As a result, the exhaust gasses entering the pipe 434 of the muffler casing 420 through the inlet pipe 424 can expand into the inlet chamber 444 and into the resonant chamber 442 of the muffler casing 420.

The muffler assembly 410 according to the fifth exemplary embodiment of the present invention is operable in a number of different modes including a high-performance mode and a bypass mode, determined by the positions of the valve 64. As described hereinabove, the valve assembly 62 is selectively and independently controlled by the ECU 16 depending on one or more operating parameters of the internal combustion engine 2 and/or the muffler assembly 410, including the inlet and outlet exhaust gas pressure monitored by the pressure sensors 17 and 18 (shown in FIG. 16).

In the bypass mode illustrated in FIG. 17, the valve 64 is closed. The exhaust gas flows through the pipe 434 until reaches the closed valve 64. The exhaust gas bypasses the diverter valve 64 and flows first into the inlet chamber 444 through the first perforated section 434*c*, then through the perforated baffle plate 436 into the resonant chamber 442. From the resonant chamber 442 the exhaust gas flows out of the muffler casing 420 through the second perforated section 434*d* and the exit port 427.

In the high-performance mode illustrated in FIG. 18, the valve 64 is open. The exhaust gas flow freely passes directly through the pipe 434, as denoted by directional arrows F. The direct non-restricted exhaust gas flow through the muffler assembly 410 increases the exhaust flow of the engine 2, reduces backpressure of the exhaust gas and increases efficiency of the turbocharger 4. Lower restriction in the exhaust system 401 provides better fluid exchange in the combustion chamber, therefore the power output of the engine 2 increases. Therefore, in the high-performance mode, the muffler assembly 410 allows for a higher flow of the exhaust gas and lower exhaust gas backpressure that, in turn, allows the turbocharger 4 and the engine 2 to breathe and function more efficiently.

Figure 19:
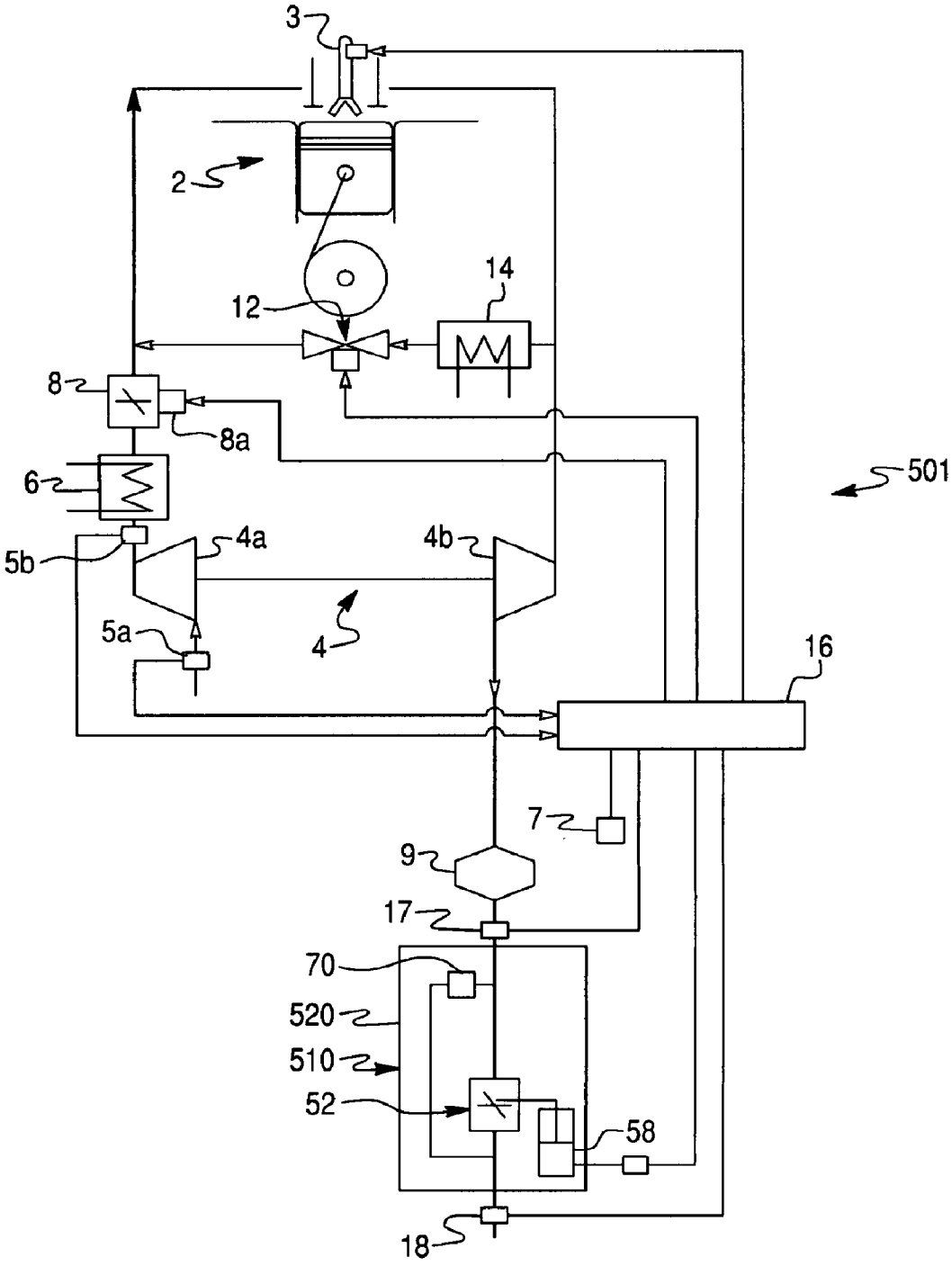
FIG. 19 is a schematic view of an exhaust system of an internal combustion engine including a muffler assembly according to a sixth exemplary embodiment of the present invention.
Figure 20:
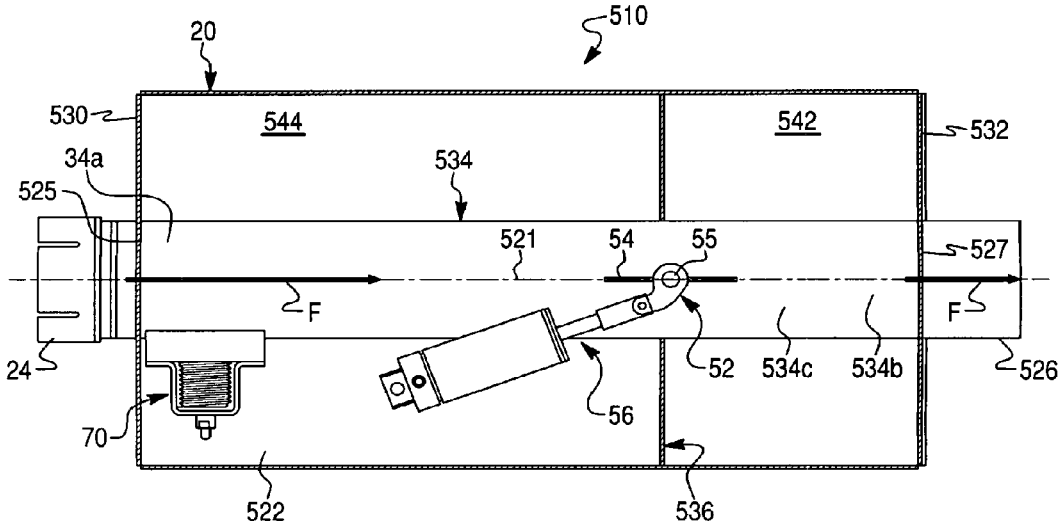
FIG. 20 is a sectional view of a muffler assembly in accordance with the sixth exemplary embodiment of the present invention in a high-performance mode.
Figure 21:
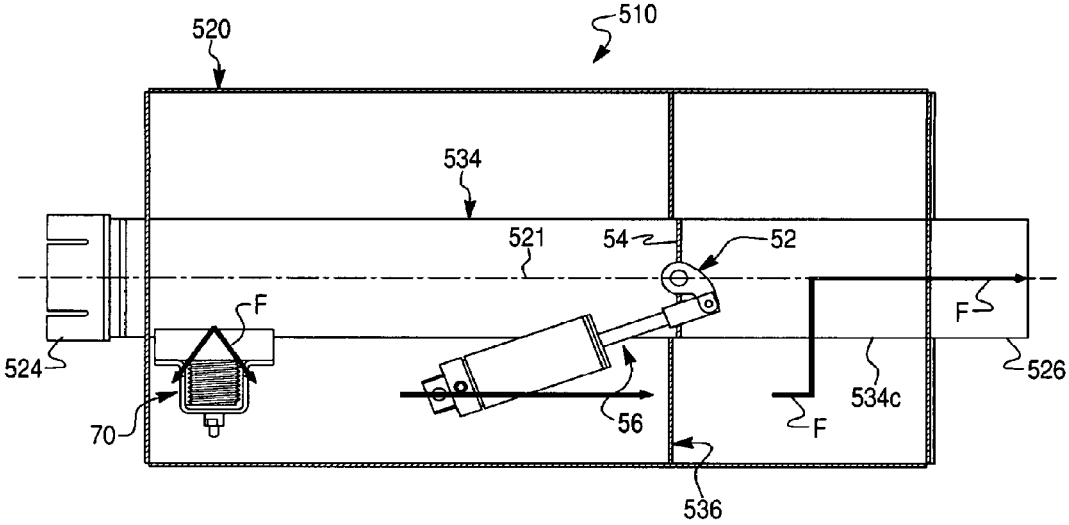
FIG. 21 is a sectional view of the muffler assembly in accordance with the sixth exemplary embodiment of the present invention in an exhaust braking mode.

FIGS. 19-21 illustrate a sixth exemplary embodiment of a muffler assembly, generally depicted by the reference character 510. Components, which are unchanged from the first exemplary embodiment of the present invention, are labeled with the same reference characters. Components, which function in the same way as in the first exemplary embodiment of the present invention depicted in FIGS. 1-6 are designated by the same reference numerals to some of which 500 has been added, sometimes without being described in detail since similarities between the corresponding parts in the two embodiments will be readily perceived by the reader.

A difference between the muffler assembly 510 of FIGS. 19-21 with respect to the muffler assembly 10 of FIGS. 1-6 is that in this case the muffler assembly 510 includes a single pipe 534 mounted within the casing 520 and only one valve assembly 52 mounted within the pipe 534. The pipe 534 extends between front and rear walls 530 and 532 of the muffler casing 520 substantially coaxially to a central axis 521. More specifically, the pipe 534 has an open inlet end 534*a* attached to an inlet port 525 and an open outlet end 534*b* attached to an exit port 527 of the casing 520. In other words, the inlet and outlet distal ends 534*a*, 534*b* of the pipe 534 are attached to the inlet and exit pipes 524 and 526, respectively.

A perforated baffle plate 536 divides an internal cavity 522 of the casing 520 into two chambers 542 and 544. The first (resonant) chamber 542 is defined within the casing 520 about the pipe 534 between the baffle plate 536 and a rear wall 532 of the casing 520. The baffle plate 536 has a central opening so as to receive the pipe 534 therethrough. The second (inlet) chamber 544 is defined within the casing 520 and about the pipe 534 between the baffle plate 536 and a front wall 530 of the casing 520. The inlet chamber 544 is in fluid communication with the resonant chamber 542 through the perforated baffle plate 536. The inlet chamber 544 is not in direct fluid communication with the inlet port 525. The pipe 534 also comprises a perforated section (or at least one aperture) 534*c* positioned between the baffle plate 536 and the rear wall 532 of the muffler casing 520. Thus, the resonant chamber 542 is in fluid communication with the exit port 527.

According to the sixth exemplary embodiment of the present invention, the valve assembly 52 functions as an exhaust brake device. Preferably, the valve assembly 52 includes an exhaust valve 54 selectively movable between a closed position and an open position for preventing the exhaust gas flow through an outlet end 534*b* of the pipe 534 when the exhaust valve 54 is in the closed position. Specifically, when the exhaust valve 54 is in the open position, as illustrated in FIG. 20, the exhaust gas can flow out the pipe 534, while when the exhaust valve 54 is in the closed position, as illustrated in FIG. 21, the exhaust gas is prevented from flowing through the outlet end 534*b* of the pipe 534. At the same time, similarly to the first exemplary embodiment of the present invention, an orifice is provided between the exhaust valve 54 and the pipe 534 to allow some exhaust gas flow through the pipe 534 when the exhaust valve 54 is in the closed position. In the preferred embodiment, the exhaust valve 54 is an exhaust restrictor in the form of butterfly valve mounted within the pipe 534 for rotation about a shaft 55. The first valve 54 is dimensioned so as to provide a gap (orifice) between an inner peripheral surface of the pipe 534 and a circumferential edge of the first valve 54 when the first valve 54 is in its closed position (similarly to the orifice 39 of the embodiment illustrated in FIG. 6). Preferably, the orifice is substantially annular in shape.

The muffler assembly 510 further comprises an automatically, mechanically actuated pressure relief (or pressure regulator) valve 70 disposed inside the casing 520 upstream of the exhaust valve 54. The pressure relief valve 70 is provided for selectively fluidly connecting the inlet end 334*a* of the pipe 534 to the exit port 427 by bypassing the exhaust valve 54. More specifically, the pressure relief valve 70 fluidly connecting the inlet end 534*a* of the pipe 534 to the inlet chamber 544 when the pressure in the pipe 534 reaches a predetermined high value.

The muffler assembly 510 according to the sixth exemplary embodiment of the present invention is operable in a number of different modes including a high-performance mode, and an exhaust braking mode, determined by the positions of the valve assembly 52 of the muffler assembly 510. As described hereinabove and illustrated in FIG. 19, the valve assembly 52 is selectively and independently controlled by the ECU 16 depending on one or more operating parameters of the internal combustion engine 2 and/or the muffler assembly 510, including the inlet and outlet exhaust gas pressure monitored by the pressure sensors 17 and 18.

In the high-performance mode illustrated in FIG. 20, the exhaust valve 54 is open. The exhaust gas flow freely passes directly through the pipe 534, as denoted by directional arrows F. The direct non-restricted exhaust gas flow through the muffler assembly 510 increases the exhaust flow of the engine 2, reduces backpressure of the exhaust gas and increases efficiency of the turbocharger 4. Lower restriction in the exhaust system 501 provides better fluid exchange in the combustion chamber, therefore the power output of the engine 2 increases. Specifically, the power output of the engine 2 increases by about 4-5% when the muffler assembly 510 operates in the high-performance muffler mode. Therefore, in the high-performance mode, the muffler assembly 510 allows for a higher flow of the exhaust gas and lower exhaust gas backpressure that, in turn, allows the turbocharger and the engine 2 to breathe and function more efficiently.

In the exhaust braking mode illustrated in FIG. 21, the exhaust valve 54 is closed and the exhaust flow through the pipe 534 is restricted. As a result, the exhaust gas back pressure is increased providing an exhaust brake function to the ICE 2, thus providing the exhaust brake function to the motor vehicle. When the pressure of exhaust gas in the pipe 534 acting on the pressure relief valve 70 becomes higher than a predetermined value the pressure relief valve 70 moves into its open position. Consequently, the exhaust gas flow F is forced to flow through the pressure relief valve 70 into the inlet chamber 544, then through the perforated baffle plate 536 into the resonant chamber 542, thus bypassing the exhaust valve 54. Then, the exhaust gas flows into the pipe 534 through the perforated section 534*c* and exits the muffler assembly 510 through the exit port 527. Therefore, the pressure relief valve 70 is provided for selectively fluidly connecting the inlet end 534*a* of the pipe 534 to the exit port 525 by bypassing the exhaust valve 54 in the exhaust braking mode.

Figure 22:
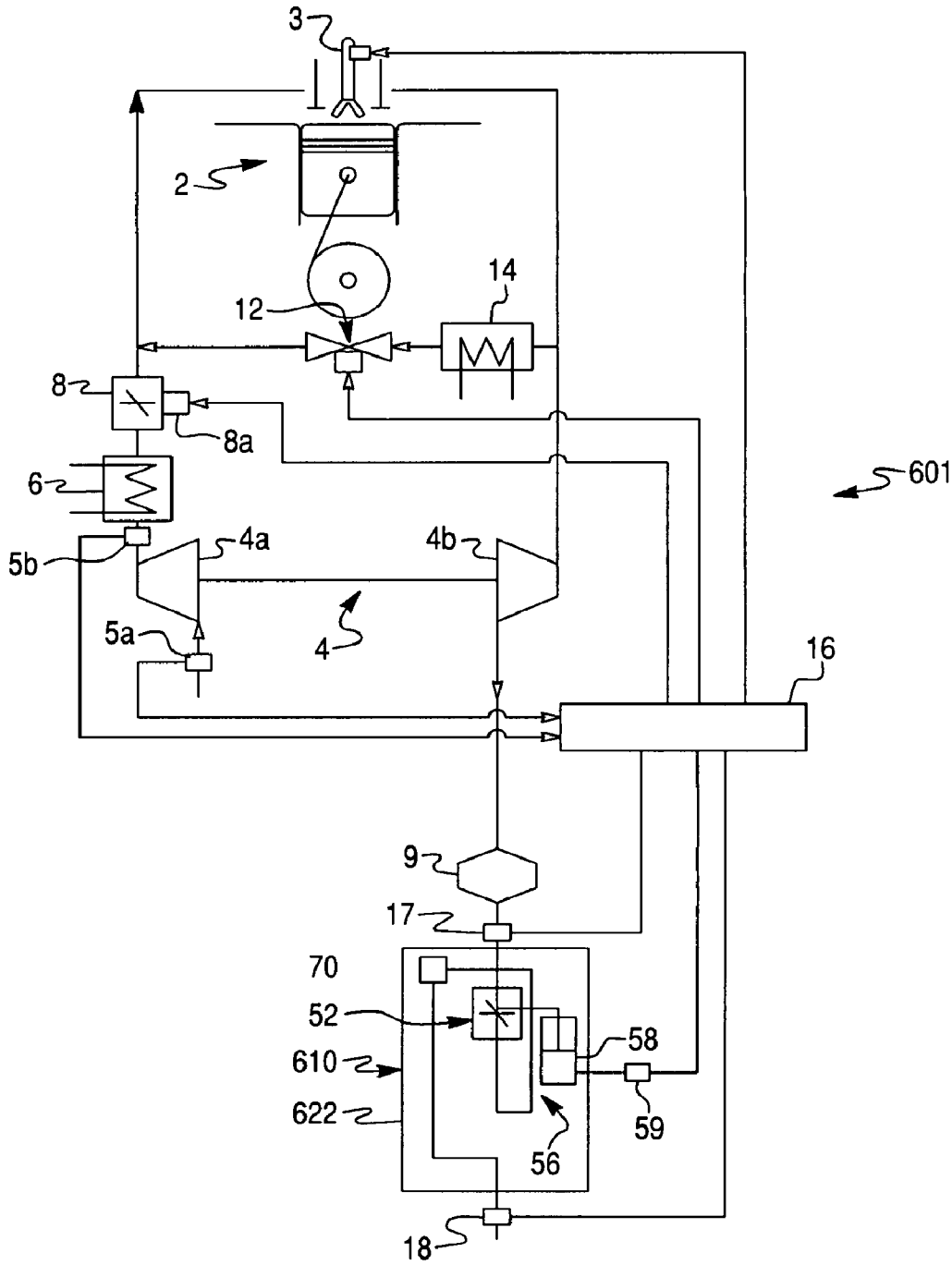
FIG. 22 is a schematic view of an exhaust system of an internal combustion engine including a muffler assembly according to a seventh exemplary embodiment of the present invention.
Figure 23:
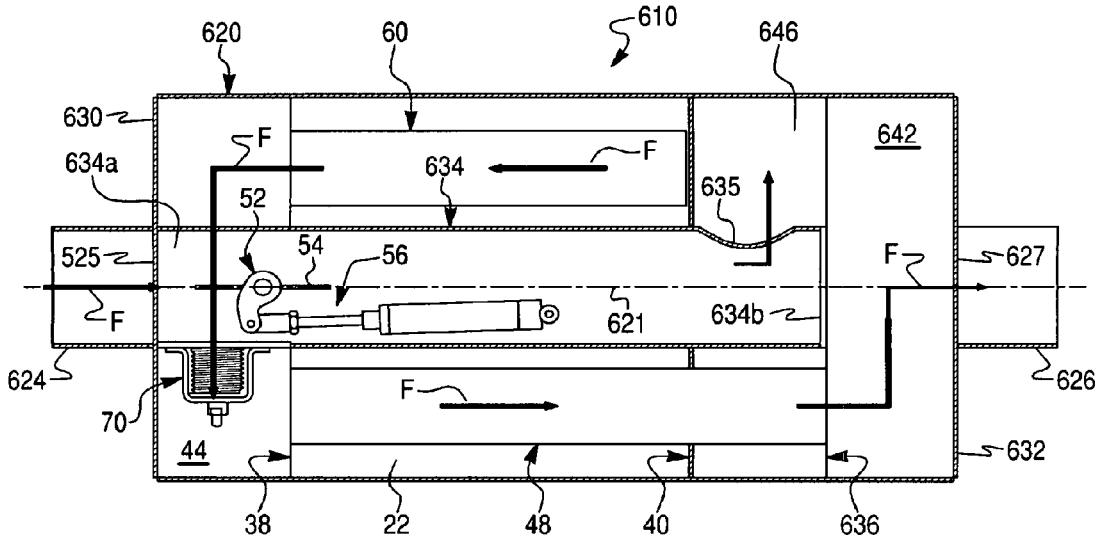
FIG. 23 is a sectional view of a muffler assembly according to the seventh exemplary embodiment of the present invention in a reverse flow mode.
Figure 24:
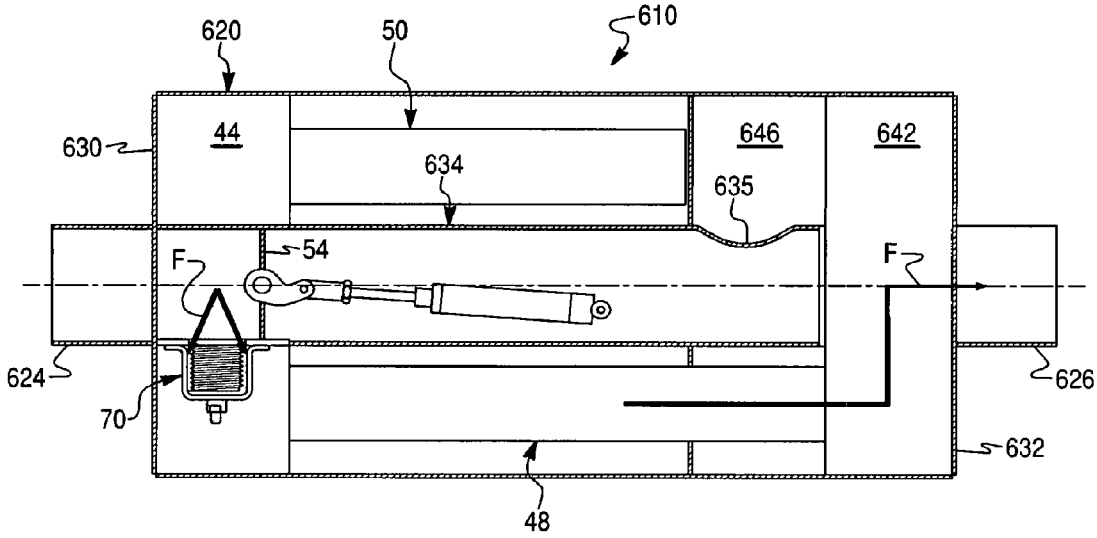
FIG. 24 is a sectional view of the muffler assembly in accordance with the seventh exemplary embodiment of the present invention in an exhaust braking mode.

FIGS. 22-24 illustrate a seventh exemplary embodiment of a muffler assembly, generally depicted by the reference character 610. Components, which are unchanged from the first exemplary embodiment of the present invention, are labeled with the same reference characters. Components, which function in the same way as in the first exemplary embodiment of the present invention depicted in FIGS. 1-6 are designated by the same reference numerals to some of which 600 has been added, sometimes without being described in detail since similarities between the corresponding parts in the two embodiments will be readily perceived by the reader.

A difference between the muffler assembly 610 of FIGS. 22-24 with respect to the muffler assembly 10 of FIGS. 1-6 is that in this case the muffler assembly 610 includes only one valve assembly 52 mounted within the casing 620, and that a first pipe 634 centrally located within the casing 620 and extending substantially coaxially to a central axis 621 of the casing 620 between inlet and exit ports 625 and 627 thereof, has an open inlet end 634*a* attached to the inlet port 625 but a closed outlet end 634*b* engaging a first baffle plate 636. In other words, the outlet end 634*b* of the first pipe 634 is closed to a resonant chamber 642.

The first pipe 634 passes through the second and third baffle plates 38 and 40, and engages the first baffle plate 636 at the outlet end 634*b* thereof. The first pipe 634 is also provided with a bypass opening 635 adjacent to the outlet end 634*b* thereof so as to provide fluid communication between the first pipe 634 and a reverse-flow chamber 646.

According to the sixth exemplary embodiment of the present invention, the valve assembly 52 functions as an exhaust brake device. Preferably, the valve assembly 52 includes an exhaust valve 54 selectively movable between a closed position and an open position for preventing the exhaust gas from flowing through the first pipe 634 when the exhaust valve 54 is in the closed position. Specifically, when the exhaust valve 54 is in the open position, as illustrated in FIG. 23, the exhaust gas can flow out the first pipe 634, while when the exhaust valve 54 is in the closed position, as illustrated in FIG. 214 the exhaust gas is prevented from flowing through the first pipe 634. At the same time, similarly to the first exemplary embodiment of the present invention, an orifice is provided between the exhaust valve 54 and the first pipe 634 to allow some exhaust gas flow through the first pipe 634 when the exhaust valve 54 is in the closed position. In the preferred embodiment, the exhaust valve 54 is an exhaust restrictor is a butterfly valve mounted within the first pipe 634 for rotation about a shaft 55. The first valve 54 is dimensioned so as to provide a gap (orifice) between an inner peripheral surface of the first pipe 634 and a circumferential edge of the first valve 54 when the first valve 54 is in its closed position (similarly to the orifice 39 of the embodiment illustrated in FIG. 6). Preferably, the orifice is substantially annular in shape.

The muffler assembly 610 further comprises an automatically, mechanically actuated pressure relief (or pressure regulator) valve 70 disposed inside the casing 620 upstream of the exhaust valve 54. The pressure relief valve 70 is provided for selectively fluidly connecting the inlet end 634*a* of the first pipe 634 to the inlet and resonant chambers 44 and 642, respectively, by bypassing the exhaust valve 54. More specifically, the pressure relief valve 70 fluidly connecting the inlet end 634*a* of the pipe 634 to the inlet chamber 44 when the pressure in the first pipe 634 reaches a predetermined high value. As illustrated in FIGS. 23 and 24, the pressure relief valve 70 is mounted to the first pipe 634 adjacent to the inlet end 634*a* thereof upstream of the exhaust valve 54.

The muffler assembly 610 according to the sixth exemplary embodiment of the present invention is operable in a number of different modes including a reverse-flow mode, and an exhaust braking mode, determined by the positions of the valve assembly 52 of the muffler assembly 610. As described hereinabove and illustrated in FIG. 22, the valve assembly 52 is selectively and independently controlled by the ECU 16 depending on one or more operating parameters of the internal combustion engine 2 and/or the muffler assembly 610, including the inlet and outlet exhaust gas pressure monitored by the pressure sensors 17 and 18.

In the reverse-flow mode illustrated in FIG. 23, the exhaust brake valve 54 is open. The exhaust gas flows through the first pipe 634 until reaches the closed outlet end 634*b* thereof. The exhaust gas reverses its flow through the third pipe 50 into the inlet chamber 44, and then goes through the second pipe 48 to the resonant chamber 642. From the resonant chamber 642 the exhaust gas flows out of the casing 620 of the muffler assembly 610. In the reverse-flow mode, the exhaust gas flows through longer path inside the casing 20, thus resulting in better muffling the exhaust gas noise by the muffler assembly 610.

In the exhaust braking mode illustrated in FIG. 24, the exhaust brake valve 54 is closed and the exhaust flow through the first pipe 634 is restricted. As a result, the exhaust gas back pressure is increased providing an exhaust brake function to the ICE 2, thus providing the exhaust brake function to the motor vehicle. When the pressure of exhaust gas in the first pipe 634 acting on the pressure relief valve 70 becomes higher than the predetermined value the pressure relief valve 70 moves into its open position. Consequently, the exhaust gas flow F is forced to flow through the pressure relief valve 70 into the inlet chamber 44, then through the third pipe 48 into the resonant chamber 642, thus bypassing the exhaust brake valve 54. From the resonant chamber 642 the exhaust gas exits the muffler assembly 610 through the exit port 627. Therefore, the pressure relief valve 70 is provided for selectively fluidly connecting the inlet end 634*a* of the first pipe 634 to the exit port 627 by bypassing the exhaust brake valve 54 in the exhaust braking mode.

Figure 25:
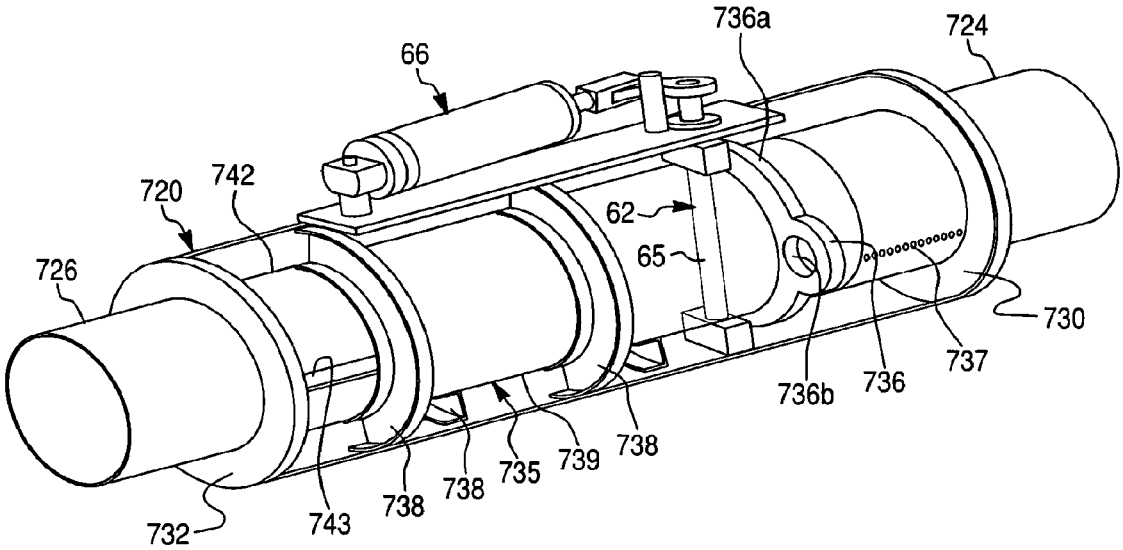
FIG. 25 is a partial perspective view of a muffler assembly according to an eighth exemplary embodiment of the present invention.
Figure 26:
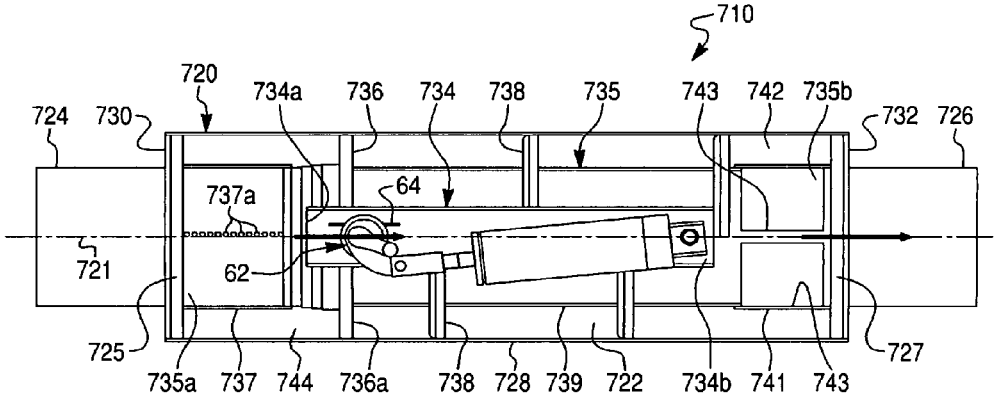
FIG. 26 is a sectional view of a muffler assembly according to the eighth exemplary embodiment of the present invention in a bypass mode.
Figure 27:
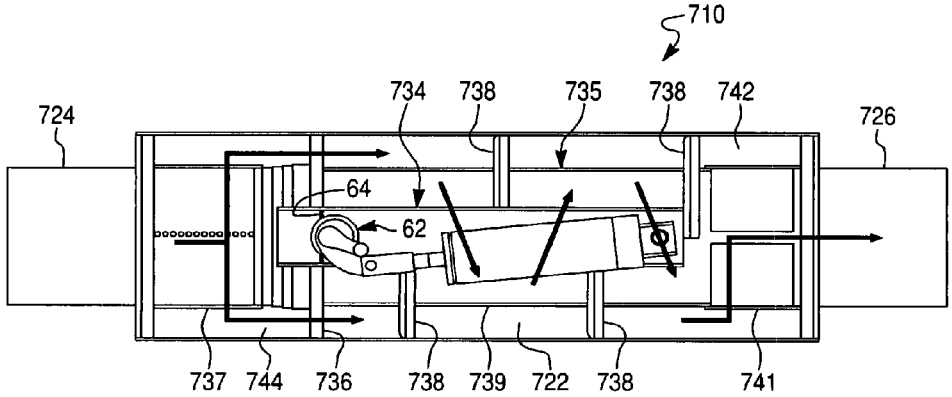
FIG. 27 is a sectional view of the muffler assembly in accordance with the eighth exemplary embodiment of the present invention in a high-performance mode.

FIGS. 25-27 illustrate an eighth exemplary embodiment of a muffler assembly, generally depicted by the reference character 710. Components, which are unchanged from the first exemplary embodiment of the present invention, are labeled with the same reference characters. Components, which function in the same way as in the first exemplary embodiment of the present invention depicted in FIGS. 1-6 are designated by the same reference numerals to some of which 700 has been added, sometimes without being described in detail since similarities between the corresponding parts in the two embodiments will be readily perceived by the reader.

A difference between the muffler assembly 710 of FIGS. 25-27 and the muffler assembly 10 of FIGS. 1-6 is that the muffler assembly 710 includes only one valve assembly 52 mounted within a casing 720, and that a first pipe 734 is centrally located within a second pipe 735 which, in turn, is centrally located within the casing 720 and extending substantially coaxially to a central axis 721 of the casing 720 between inlet and exit ports 725 and 727 thereof.

The first pipe 734 has an open inlet end 734*a* axially spaced from the front wall 730 of the casing 720 and an open outlet end 734*b* axially spaced from the rear wall 730 thereof. The second pipe 735 has an open inlet end 735*a* attached to the inlet port 725 and an open outlet end 735*b* attached to the exit port 727. Moreover, the second pipe 735 has a front section 737 adjacent to the front wall 730 of the casing 720 and upstream of a first valve 54, a rear section 741 adjacent to the rear wall 732 of the casing 720 and a central section 739 extending between the front and rear sections 737 and 741 of the second pipe 735. The front section 737 of the second pipe 735 has one or more apertures 737*a* so as to provide fluid communication between the second pipe 735 and an internal cavity 722 within the casing 720. Preferably, the front section 737 of the second pipe 735 is perforated, as shown in FIGS. 26 and 27. The rear section 741 of the second pipe 735 has one or more apertures (or window) 743 so as to provide fluid communication between the second pipe 735 and the internal cavity 722 within the casing 720. The central section 739 of the second pipe 735 is impervious for exhaust gas flow.

The muffler assembly 710 further comprises a baffle plate 736 dividing the internal cavity 722 within the muffler casing 720 so as to define a resonant chamber 742 between the baffle plate 736 and the rear wall 732 of the casing 720 and an inlet chamber 744 between the baffle plate 736 and the front wall 730 of the casing 720. The baffle plate 736 has one or more apertures 736*a* and 736*b* so as to provide fluid communication between the inlet chamber 744 and the resonant chamber 742.

The muffler assembly 710 further comprises one or more baffle members 740 in the resonant chamber 742 between the outer wall 728 of the casing 720 and the second pipe 735. The baffle members 740 define a tortuous path of the exhaust gas flow through the resonant chamber 742. Preferably, the muffler assembly comprises a plurality of the baffle members 738 each of the baffle members 738 is in the form of a semi-annular (half-moon) plate disposed opposite to each other in an alternating manner, as illustrated in FIG. 25.

The muffler assembly 710 according to the eighth exemplary embodiment of the present invention is operable in a number of different modes including a high-performance mode and a bypass mode, determined by the positions of the valve 64. As described hereinabove, the valve assembly 62 is selectively and independently controlled by the ECU 16 depending on one or more operating parameters of the internal combustion engine 2 and/or the muffler assembly 710, including the inlet and outlet exhaust gas pressure monitored by the pressure sensors 17 and 18.

In the bypass mode illustrated in FIG. 27, the valve 64 is closed. The exhaust gas flows through the second pipe 735 into the first pipe 734 until reaches the closed valve 64. The exhaust gas bypasses the diverter valve 64 and flows first into the inlet chamber 744 through the front perforated section 737, then through the apertures 736*a* and 736*b* in the baffle plate 736 into the resonant chamber 742. The exhaust gas flows through the resonant chamber 742 in the tortuous path by deflecting from the semi-annular baffle members 740, as illustrated in FIG. 27. From the resonant chamber 742 the exhaust gas flows out of the muffler casing 720 through the windows 743 in the rear section 741 and the exit port 727.

In the high-performance mode illustrated in FIG. 26, the valve 64 is open. The exhaust gas flow freely passes directly through the first and second pipes 734 and 735, as denoted by directional arrows F. In the high-performance mode, the muffler assembly 710 allows for a higher flow of the exhaust gas and lower exhaust gas backpressure that, in turn, allows the turbocharger and the engine to breathe and function more efficiently.

Therefore, the muffler assembly in accordance with the present invention allows for multiple modes of operation in order to improve and optimize operational characteristics of the internal combustion engine.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A muffler assembly for an internal combustion engine, said muffler assembly comprising:

an elongated casing having an inlet port and an exit port, said casing including a continuous outer wall extending along a central axis of said casing between a front wall defining said inlet port and a rear wall defining said exit port;

a first pipe disposed within said casing and having an inlet end in fluid communication with said inlet port and an outlet end selectively fluidly connected to said exit port of said casing;

a first valve mounted within said casing, said first valve being selectively movable between a closed position and an open position for regulating an exhaust gas flow through said first pipe;

a pressure relief valve disposed inside said casing upstream of said first valve, said pressure relief valve is selectively movable between a closed position and an open position for selectively fluidly connecting said inlet end of said first pipe to said exit port by bypassing said first valve, and said pressure relief valve moves into said open position when a pressure of exhaust gas acting on said pressure relief valve is higher than a predetermined value.

2. The muffler assembly as defined in claim 1, wherein said pressure relief valve is normally biased in said closed position by a bias spring.

3. The muffler assembly as defined in claim 2, wherein said pressure relief valve is mounted to said first pipe adjacent to said inlet end thereof.

4. The muffler assembly as defined in claim 1, further comprising a second valve mounted within said casing downstream of said first valve, said second valve is selectively movable between a closed position and an open position for preventing exhaust gas flow through said outlet end of said first pipe when said second valve is in said closed position; said first valve is movable independently from said second valve.

5. The muffler assembly as defined in claim 4, wherein said first valve is disposed adjacent to said inlet end of said first pipe and said second valve is disposed adjacent to said outlet end thereof.

6. The muffler assembly as defined in claim 5, wherein both said first valve and said second valve are mounted within said first pipe.

7. The muffler assembly as defined in claim 4, wherein the internal combustion engine is operable in an engine compression release braking mode, and wherein said second valve is closed when the engine is in the engine compression release braking mode.

8. A muffler assembly for an internal combustion engine, said muffler assembly comprising:

an elongated casing having an inlet port and an exit port, said casing including a continuous outer wall extending along a central axis of said casing between a front wall defining said inlet port and a rear wall defining said exit port;

a first pipe disposed within said casing and having an inlet end in fluid communication with said inlet port and an outlet end selectively fluidly connected to said exit port of said casing;

a first valve mounted within said casing, said first valve being selectively movable between a closed position and an open position for regulating an exhaust gas flow through said first pipe;

a pressure relief valve disposed inside said casing upstream of said first valve, said pressure relief valve is selectively movable between a closed position and an open position for selectively fluidly connecting said inlet end of said first pipe to said exit port by bypassing said first valve, and said pressure relief valve moves into said open position when a pressure of exhaust gas acting on said pressure relief valve is higher than a predetermined value;

a second valve mounted within said casing downstream of said first valve, said second valve being selectively movable between a closed position and an open position for preventing exhaust gas flow through said outlet end of said first pipe when said second valve is in said closed position; and a first actuator for selectively moving said first valve between said closed and open positions and a second actuator for selectively moving said second valve between said closed and open positions;

said first actuator controlled independently from said second actuator.

9. The muffler assembly as defined in claim 8, further comprising an electronic control unit operably associated with both said first and second actuators for independently operating said first and second actuators in response to at least one operating parameter of at least one of said muffler assembly and the internal combustion engine.

10. The muffler assembly as defined in claim 9, wherein each of said first and second actuators is one of a pneumatic actuator, vacuum actuator, a hydraulic actuator, electro-mechanical actuator and electro-magnetic actuator.

11. The muffler assembly as defined in claim 1, wherein said first pipe extends substantially coaxially to said central axis of said casing between said front and rear walls of said casing.

12. The muffler assembly as defined in claim 4, further comprising a first perforated baffle plate axially spaced from said rear wall so as to define a resonant chamber within said casing between said first perforated baffle plate and said rear wall of said casing, and a second perforated baffle plate axially spaced from said front wall and said first baffle plate so as to define an inlet chamber within said casing between said second perforated baffle plate and said front wall of said casing; said first and second perforated baffle plates further define a central chamber therebetween; and said inlet end of said first pipe is fluidly connected to said inlet chamber when said pressure relief valve in said open position.

13. The muffler assembly as defined in claim 12, wherein said first pipe further includes at least one aperture positioned between said first perforated baffle plate and said rear wall of said casing downstream of said second valve so as to provide fluid communication between said resonant chamber and said exit port through said outlet end of said first pipe;

said first pipe further includes at least one aperture positioned between said first and second valves so as to provide fluid communication between said central chamber and said first pipe between said first and second valves; and said inlet end of said first pipe is fluidly connected to said inlet chamber when said pressure relief valve in said open position.

14. The muffler assembly as defined in claim 13, wherein said muffler assembly is operable in an exhaust braking mode when both said first and second valves are in said closed position.

15. The muffler assembly as defined in claim 13, wherein said muffler assembly is operable in a straight flow mode when both said first and second valves are in said open position.

16. The muffler assembly as defined in claim 13, wherein said muffler assembly is operable in a bypass mode when said first valve is said open position and said second valve is in said closed position.

17. The muffler assembly as defined in claim 9, wherein said at least one operating parameter is one of speed of the internal combustion engine, inlet pressure of exhaust gas flow at said inlet port, outlet pressure of exhaust gas flow at said exit port, inlet temperature of exhaust gas flow at said inlet port, outlet temperature of exhaust gas flow at said exit port, acoustic energy generated by said muffler assembly, and vibration generated by said muffler assembly.

18. The muffler assembly as defined in claim 17, wherein the acoustic energy is monitored by an acoustic sensor detecting acoustic frequencies generated by said muffler assembly.

19. The muffler assembly as defined in claim 18, wherein said acoustic sensor is mounted to said muffler assembly.

20. The muffler assembly as defined in claim 17, wherein the vibration is monitored by an accelerometer mounted to said muffler assembly.

* * * * *